US009993050B2

(12) United States Patent
Lee et al.

(10) Patent No.: US 9,993,050 B2
(45) Date of Patent: Jun. 12, 2018

(54) WEARABLE ELECTRONIC DEVICE HAVING BUCKLE

(71) Applicant: Samsung Electronics Co., Ltd., Gyeonggi-do (KR)

(72) Inventors: Jin-Hak Lee, Gyeonggi-do (KR); Byoung-Uk Yoon, Gyeonggi-do (KR); Chong-Du Kim, Gyeonggi-do (KR); Youn-Jin Nam, Seoul (KR); Seung-Kwon Choi, Gyeonggi-do (KR)

(73) Assignee: Samsung Electronics Co., Ltd., Samsung-ro, Yeongtong-gu, Suwon-si, Gyeonggi-do (KR)

( * ) Notice: Subject to any disclaimer, the term of this patent is extended or adjusted under 35 U.S.C. 154(b) by 215 days.

(21) Appl. No.: 14/683,553

(22) Filed: Apr. 10, 2015

(65) Prior Publication Data

US 2015/0289607 A1 Oct. 15, 2015

(30) Foreign Application Priority Data

Apr. 11, 2014 (KR) ..... 10-2014-0043836

(51) Int. Cl.
*A44C 5/00* (2006.01)
*G04B 37/00* (2006.01)
*A44C 5/20* (2006.01)

(52) U.S. Cl.
CPC ..... *A44C 5/2076* (2013.01)

(58) Field of Classification Search
CPC .... A44C 5/00; A44C 5/24; A44C 5/14; A44C 5/2076; G04B 3/14; G04B 37/00; G04B 37/16
USPC ..... 224/164, 179
See application file for complete search history.

(56) References Cited

U.S. PATENT DOCUMENTS 3,376,616 A * 4/1968 Kaczorowski ..... A44B 11/258 24/303
3,585,744 A * 6/1971 Arnone ..... A44C 5/0015 224/165
4,468,134 A * 8/1984 Halicho ..... G04B 39/00 368/308
4,757,486 A * 7/1988 Wollman ..... G04B 37/1486 224/164
5,668,784 A * 9/1997 Iguchi ..... G04B 37/1486 224/164
5,812,500 A * 9/1998 Webb, Jr. ..... A44C 5/0053 368/10
6,216,490 B1 * 4/2001 Radley-Smith ..... A44C 5/0015 345/56
6,556,222 B1 * 4/2003 Narayanaswami .. G04G 9/0064 368/295
7,251,197 B2 * 7/2007 Yoshida ..... H04B 1/385 368/10

(Continued)

FOREIGN PATENT DOCUMENTS

KR 10-2012-0107932 A 10/2012

*Primary Examiner* — Brian D Nash
(74) *Attorney, Agent, or Firm* — Cha & Reiter, LLC

(57) ABSTRACT

According to various embodiments, there is provided a wearable electronic device including a main body, at least one strap connected to at least one part of the main body, a buckle installed to an end portion of the strap, and a connection member for connecting the buckle and the strap. Accordingly, hardness and aesthetic feeling can be improved, while improving an assembling capability, reducing a manufacturing cost, and contributing to a slimness of the device.

14 Claims, 23 Drawing Sheets

(56) References Cited

U.S. PATENT DOCUMENTS

| | | | | |
|---|---|---|---|---|
| 8,590,114 | B2 * | 11/2013 | Shindo | A44B 11/006 224/164 |
| 8,613,544 | B2 * | 12/2013 | Kitahara | B29C 70/70 368/282 |
| 8,763,869 | B2 * | 7/2014 | Gerard-Goddet | A44C 5/0053 224/164 |
| 8,824,245 | B2 * | 9/2014 | Lau | G04G 21/08 368/296 |
| 2004/0057340 | A1 * | 3/2004 | Charles-Erickson | G06F 19/3418 368/10 |
| 2005/0217080 | A1 * | 10/2005 | Kojoori | A44B 11/006 24/265 WS |
| 2007/0067967 | A1 * | 3/2007 | Sima | A44C 5/147 24/265 WS |
| 2007/0200716 | A1 * | 8/2007 | Haase | G08B 15/004 340/574 |
| 2009/0274015 | A1 * | 11/2009 | Sun | A44C 5/0053 368/282 |
| 2011/0197400 | A1 * | 8/2011 | Chevrolet | A44C 5/14 24/265 B |
| 2012/0240361 | A1 | 9/2012 | Leger et al. | |
| 2014/0353349 | A1 * | 12/2014 | De Oliveira | A44C 5/14 224/164 |
| 2014/0380186 | A1 * | 12/2014 | Kim | G09G 3/2092 715/746 |
| 2015/0241917 | A1 * | 8/2015 | Seok | A61B 5/681 361/679.03 |

* cited by examiner

WEARABLE ELECTRONIC DEVICE HAVING BUCKLE

CLAIM OF PRIORITY

This application claims the benefit under 35 U.S.C. § 119(a) of a Korean patent application filed in the Korean Intellectual Property Office on Apr. 11, 2014 and assigned Serial No. 10-2014-0043836, the entire disclosure of which is hereby incorporated by reference.

BACKGROUND

1. Technical Field

Various embodiments of the present disclosure relate to an electronic device, and for example, to a wearable electronic device including a buckle.

2. Description of the Related Art

Electronic devices being developed recently tend to be smaller and slimmer to facilitate portability while performing the same or more various functions. The small-sized electronic devices are placed in a pocket of a user in general, but in particular, may be worn on a head portion, arm, wrist, or the like of a human body.

A wearable device that can be worn on a human body or various constructions may generally include a main body for performing an intrinsic function of an electronic device and a strap which is placed to be stretched out from the main body with a specific length and which fastens the device to the human body or the constructions. The wearable devices may be used standalone, or may be used dependent on the other electronic devices. In case of being used dependent on the other electronic devices, a communication scheme based on a near-distance communication module may be accepted, and a cumbersome and frequent use of the other electronic devices may be restrained by the use of the wearable electronic device. Accordingly, the wearable electronic device is more and more widely used.

Since a wearable device is attached (or worn) to a human body or a construction in an exposed manner, the design and aesthetic feeling of the device may be of importance. Wearing comfort may be an important issue to be considered when the wearable device is worn on the human body.

Meanwhile, if a buckle with a hard material and a strap with a soft material are directly connected, a hardness of a connected portion is weak. Therefore, there is a problem in that, during or after wearing it, the buckle and the strap may have a gap therebetween or may be separated from each other according to a movement.

SUMMARY

According to various embodiments of the present disclosure, a wearable electronic device may include a buckle, which may address some of the problems discussed above.

According to an embodiment, at least one strap for supporting a main body and to be worn on a human body may include a buckle for avoiding a detachment after being worn. The buckle may have a great hardness and may recover operational reliability even if it is used for a long period of time, whereas the strap connected to the buckle is a portion attached to the human body. The buckle may have an excellent design aesthetic feeling and wearing comfort. Generally, a strap attached to the buckle may be formed from a soft or compliant material that is comfortable to wear.

According to various embodiments of the present disclosure, a wearable electronic device may include a buckle capable of fastening a buckle with a hard material to a strap with a soft material.

According to various embodiments of the present disclosure, a wearable electronic device may include a buckle configured to contribute to the slimness of the device (e.g., by not substantially increasing the thickness of the strap) while maintaining the hardness of an assembly portion.

Various embodiments of the present disclosure may provide a wearable electronic device including a buckle capable of improving an assembly capability while improving the design and aesthetic feeling of the device, as well as reducing its manufacturing cost.

Various embodiments of the present disclosure may provide a wearable electronic device including a buckle prevented from deformation even after a long time user, thereby capable of ensuring a reliability of the device.

According to various embodiments, a wearable electronic device may include a main body, at least one strap connected to at least one part of the main body, a buckle installed to an end portion of the strap, and a connection member for connecting the buckle and the strap.

According to embodiments, a wearable electronic device may include a main body having a display, at least one strap connected to at least one part of the main body, a buckle installed to an end portion of the strap, at least one band fixing pole formed to the buckle in a protruding manner and inserted to an insertion hole formed to the strap, and a connection member for connecting the buckle and the strap.

According to various embodiments, the connection member may be fastened to the strap in an insert-molding manner.

According to various embodiments, the connection member may include a band insertion portion coupled to a first insertion groove formed to one end portion of the strap, and a buckle insertion portion extended from the band insertion portion and coupled to a second insertion groove formed to the buckle.

According to an embodiment of the present disclosure, the strap may include a recess, and the buckle may be disposed within the recess of the strap. In a further embodiment, the strap may include a groove (e.g., the first insertion groove) in which a portion of the connection member may be secured. These features may contribute to a slim design.

These and other embodiments of the present disclosure are more fully described hereinbelow.

BRIEF DESCRIPTION OF THE DRAWINGS

The above and other aspects, features and advantages of certain embodiments of the present disclosure will be more apparent from the following detailed description taken in conjunction with the accompanying drawings, in which.

DETAILED DESCRIPTION

Figure 1A:
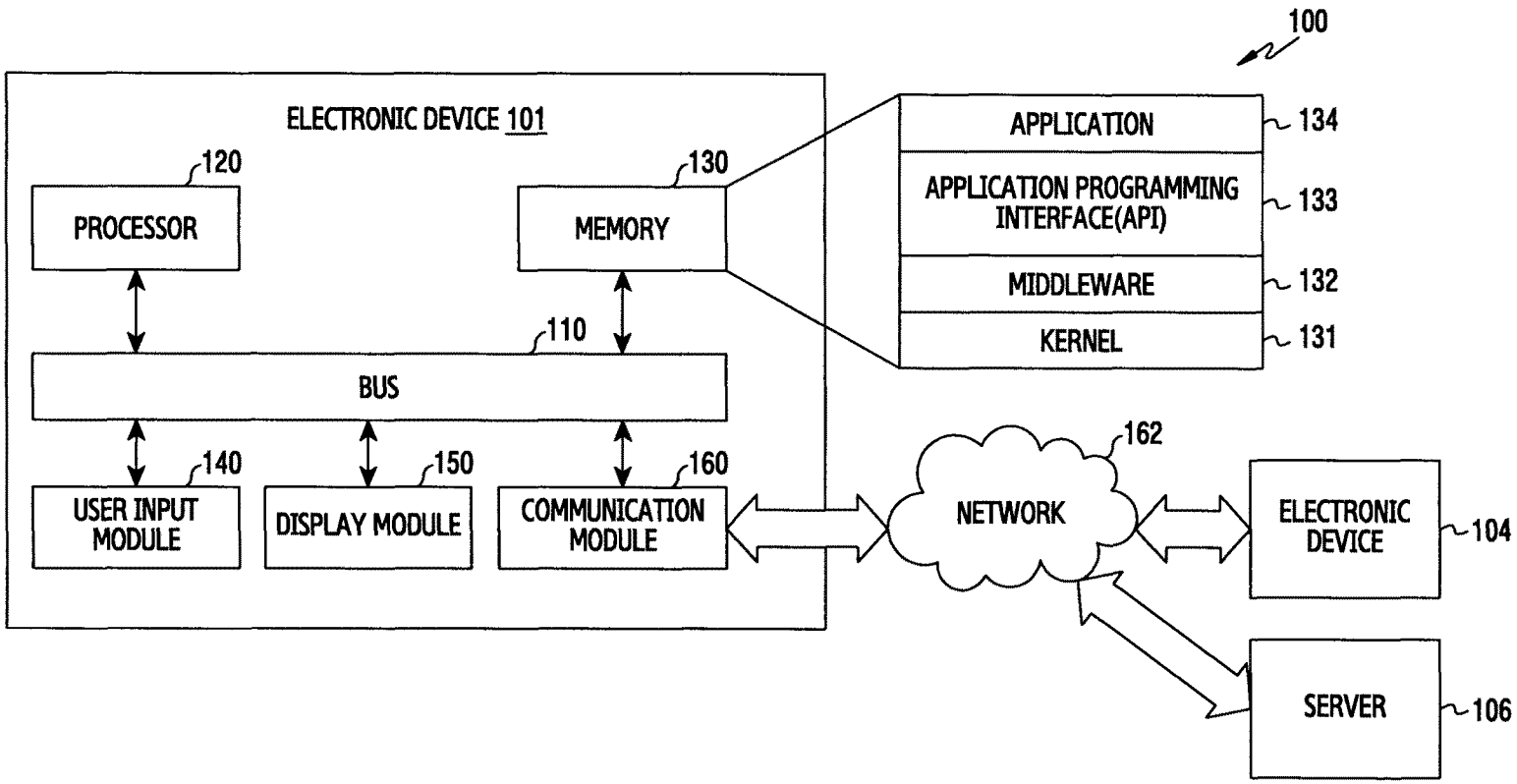
FIG. 1A illustrates a network environment including a wearable electronic device according to various embodiments of the present disclosure.

FIGS. 1A through 8B, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system and method. Hereinafter, the present disclosure is described with reference to the accompanying drawings. While the present disclosure is susceptible to various modifications and alternative forms, a specific embodiment thereof has been shown by way of example in the drawings and will herein be described in detail. It should be understood, however, that it is not intended to limit the present disclosure to the particular form disclosed, but, alternatively, the present disclosure is to cover all modifications, equivalents, and alternatives falling within the spirit and scope of the present disclosure as defined by the appended claims. Like reference numerals denote like constitutional elements throughout the drawings.

The expression "include" or "may include" used in the present disclosure is intended to indicate a presence of a corresponding function, operation, or constitutional element, and it is not intended to limit a presence of one or more functions, operations, or constitutional elements. In addition, in the present disclosure, the term "include" or "have" is intended to indicate that characteristics, numbers, steps, operations, constitutional elements, and components disclosed in the specification or combinations thereof exist. As such, the term "include" or "have" should be understood that there are additional possibilities of one or more other characteristics, numbers, steps, operations, constitutional elements, elements or combinations thereof.

In the present disclosure, an expression "or" includes any and all combinations of words enumerated together. For example, "A or B" may include A or B, or may include both A and B.

Although expressions such as "$1^{st}$", "$2^{nd}$", "first", and "second" may be used to express various constitutional elements of the present disclosure, it is not intended to limit the corresponding constitutional elements. For example, the above expressions are not intended to limit an order or an importance of the corresponding constitutional elements. The above expressions may be used to distinguish one constitutional element from another constitutional element. For example, a $1^{st}$ user device and a $2^{nd}$ user device are both user devices, and indicate different user devices. For example, a $1^{st}$ constitutional element may be termed a $2^{nd}$ constitutional element, and similarly, the $2^{nd}$ constitutional element may be termed the $1^{st}$ constitutional element without departing from the scope of the present disclosure.

When a constitutional element is mentioned as being "connected" to or "accessing" another constitutional element, this may mean that it is directly connected to or accessing the other constitutional element, but it is to be understood that there are no intervening constitutional elements present. Alternatively, when a constitutional element is mentioned as being "directly connected" to or "directly accessing" another constitutional element, it is to be understood that there are no intervening constitutional elements present.

The terminology used in the present disclosure is for the purpose of describing particular embodiments only and is not intended to be limiting of the present disclosure. A singular expression includes a plural expression unless there is a contextually distinctive difference therebetween.

Unless otherwise defined, all terms (including technical and scientific terms) used herein have the same meaning as commonly understood by those ordinarily skilled in the art to which the present disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

An electronic device according to the present disclosure may be a device including a communication function. For example, the electronic device may include at least one of a smart phone, a tablet Personal Computer (PC), a mobile phone, a video phone, an e-book reader, a desktop PC, a laptop PC, a netbook computer, a Personal Digital Assistant (PDA), a Portable Multimedia Player (PMP), a MPEG-1 Audio Layer 3 (MP3) player, a mobile medical device, a camera, and a wearable device (e.g., a Head-Mounted-Device (HMD) such as electronic glasses, electronic clothes, an electronic bracelet, an electronic necklace, an electronic appcessory, an electronic tattoo, or a smart watch).

According to certain embodiments, the electronic device may be a smart home appliance having a communication function. For example, the smart home appliance may include at least one of a TeleVision (TV), a Digital Video Disk (DVD) player, an audio, a refrigerator, an air conditioner, a cleaner, an oven, a microwave oven, a washing machine, an air purifier, a set-top box, a TV box (e.g., Samsung HomeSync™, Apple TV™, or Google TV™), a game console, an electronic dictionary, an electronic key, a camcorder, and an electronic picture frame.

According to certain embodiments, the electronic device may include at least one of various medical devices (e.g., Magnetic Resonance Angiography (MRA), Magnetic Resonance Imaging (MRI), Computed Tomography (CT), imaging equipment, ultrasonic instrument, and the like), a navigation device, a Global Positioning System (GPS) receiver, an Event Data Recorder (EDR), a Flight Data Recorder (FDR), a car infotainment device, an electronic equipment for ship (e.g., a vessel navigation device, a gyro compass, and the like), avionics, a security device, and an industrial or domestic robot.

According to certain embodiments, the electronic device may include at least one of furniture or a part of building/constructions including a screen output function, an electronic board, an electronic signature receiving device, a projector, and various measurement machines (e.g., water supply, electricity, gas, propagation measurement machine, and the like). The electronic device according to the present disclosure may be one or more combinations of the aforementioned various devices. In addition, it is apparent those ordinarily skilled in the art that the electronic device according to the present disclosure is not limited to the aforementioned devices.

According to one embodiment, the electronic device may include a plurality of displays capable of a screen output, and may output one screen by using the plurality of displays as one display or may output a screen to each display. According to one embodiment, the plurality of displays may be connected with a connection portion, for example, a hinge, to be movable in a specific angle such according to a fold-in or fold-out manner.

According to another embodiment, the electronic device may include a flexible display, and may output a screen by using the flexible display as one display or by dividing a display area into a plurality of parts with respect to a portion of the flexible display.

According to another embodiment, the electronic device may be equipped with a cover having a display protection function capable of a screen output. According to one embodiment, the electronic device may output one screen by using a display of the cover and a display of the electronic device as one display or may output a screen to each display.

Hereinafter, an electronic device according to various embodiments will be described with reference to the accompanying drawings. The term 'user' used in the various embodiments may refer to a person who uses the electronic device or a device (e.g., an Artificial Intelligence (AI) electronic device) that uses the electronic device.

FIG. 1A illustrates a network environment 100 including an electronic device 101 according to various embodiments. Referring to FIG. 1, the electronic device 101 may include a bus 110, a processor 120, a memory 130, an input/output interface 140, a display 150, and a communication interface 160.

The bus 110 may be a circuit for connecting the aforementioned constitutional elements to each other and for delivering communication (e.g., a control message) between the aforementioned constitutional elements.

The processor 120 may receive an instruction from the aforementioned different constitutional elements (e.g., the memory 130, the input/output interface 140, the display 150, the communication interface 160), for example, via the bus 110, and thus may interpret the received instruction and execute arithmetic or data processing according to the interpreted instruction.

The memory 130 may store an instruction or data received from the processor 120 or different constitutional elements (e.g., the input/output interface 140, the display 150, the communication interface 160) or generated by the processor 120 or the different constitutional elements. The memory 130 may include programming modules such as a kernel 131, a middleware 132, an Application Programming Interface (API) 133, an application 134, and the like. Each of the aforementioned programming modules may consist of software, firmware, or hardware entities or may consist of at least two or more combinations thereof.

The kernel 131 may control or manage the remaining other programming modules, for example, system resources (e.g., the bus 110, the processor 120, the memory 130, and the like) used to execute an operation or function implemented in the middleware 132, the API 133, or the application 134. In addition, the kernel 131 may provide a controllable or manageable interface by accessing individual constitutional elements of the electronic device 101 in the middleware 132, the API 133, or the application 134.

The middleware 132 may perform a mediation role such that the API 133 or the application 134 communicates with the kernel 131 to exchange data. In addition, regarding task requests received from the application 134, for example, the middleware 132 may perform a control (e.g., scheduling or load balancing) for the task requests by using a method of assigning a priority capable of using a system resource (e.g., the bus 110, the processor 120, the memory 130, and the like) of the electronic device 101 to at least one of the applications 134.

The API 133 may include at least one interface or function (e.g., instruction) for file control, window control, video processing, character control, and the like, as an interface capable of controlling a function provided by the application 134 in the kernel 131 or the middleware 132.

According to various embodiments, the application 134 may include a Short Message Service (SMS)/Multimedia Messaging Service (MMS) application, an e-mail application, a calendar application, an alarm application, a health care application (e.g., an application for measuring a physical activity level, a blood sugar, and the like) or an environment information application (e.g., atmospheric pressure, humidity, or temperature information). Additionally or alternatively, the application 134 may be an application related to an information exchange between the electronic device 101 and an external electronic device (e.g., an electronic device 104). The application related to the information exchange may include, for example, a notification relay application for relaying specific information to the external electronic device or a device management application for managing the external electronic device.

For example, the notification relay application may include a function of relaying notification information generated in another application (e.g., an SMS/MMS application, an e-mail application, a health care application, an environment information application, and the like) of the electronic device 101 to the external electronic device (e.g., the electronic device 104). Additionally or alternatively, the notification relay application may receive notification information, for example, from the external electronic device (e.g., the electronic device 104) and may provide it to the user. The device management application may manage, for example, a function for at least one part of the external electronic device (e.g., the electronic device 104), which communicates with the electronic device 101. Examples of the function include turning on/turning off the external electronic device itself (or some components thereof) or adjusting of a display illumination (or a resolution), and managing (e.g., installing, deleting, or updating) of an application which operates in the external electronic device or a service (e.g., a call service or a message service) provided by the external electronic device.

According to various embodiments, the application 134 may include an application specified according to attribute information (e.g., an electronic device type) of the external electronic device (e.g., the electronic device 104). For example, if the external electronic device is an MP3 player, the application 134 may include an application related to playing music. Similarly, if the external electronic device is a mobile medical device, the application 134 may include an application related to a health care. According to one embodiment, the application 134 may include at least one of a specified application in the electronic device 101 or an application received from the external electronic device (e.g., a server 106 or the electronic device 104).

The input/output interface 140 may relay an instruction or data input from a user via an input/output device (e.g., a sensor, a keyboard, or a touch screen) to the processor 120, the memory 130, and/or the communication interface 160, for example, via the bus 110. For example, the input/output interface 140 may provide data regarding a user's touch input via the touch screen to the processor 120. In addition, the input/output interface 140 may output an instruction or data received from the processor 120, the memory 130, the communication interface 160 to an output device (e.g., a speaker or a display), for example, via the bus 110. For example, the input/output interface 140 may output audio data provided by using the processor 120 to the user via a speaker.

The display 150 may display a variety of information (e.g., multimedia data or text data) to the user.

The communication interface 160 may connect a communication between the electronic device 101 and an external device (e.g., the electronic device 102 or 104, or the server 106). For example, the communication interface 160 may communicate with the external device by being connected with a network 162 through wireless communication or wired communication. For example, the wireless communication may include at least one of Wireless Fidelity (Wi-Fi), Bluetooth (BT), Near Field Communication (NFC), a Global Positioning System (GPS), and cellular communication (e.g., LTE, LTE-A, CDMA, WCDMA, UMTS, WiBro, GSM, and the like). For example, the wired communication may include at least one of Universal Serial Bus (USB), High Definition Multimedia Interface (HDMI), Recommended Standard (RS)-232, and Plain Old Telephone Service (POTS).

According to one embodiment, the network 162 may be a telecommunications network. The telecommunications network may include at least one of a computer network, an internet, an internet of things, and a telephone network. According to one embodiment, a protocol (e.g., a transport layer protocol, a data link layer protocol, or a physical layer protocol) for a communication between the electronic device 101 and the external device may be supported in at least one of the application 134, the API 133, the middleware 132, the kernel 131, and the communication interface 160.

According to various embodiments of the present disclosure, a wearable electronic device may be applied to various devices including at least one strap coupled to a main body.

In the explanation of various embodiments of the present disclosure, a wearable electronic device may be applied to various devices which are worn on a human body or a specific construction by the use of a strap. According to various embodiments, the wearable electronic device may be worn or attached at various positions such as a wrist, arm, head portion, or the like of the human body. However, the wearable electronic device is not limited thereto, and may be various devices fastened to a specific construction or the like, even if not the human body, by the use of the strap.

An electronic device according to various embodiments of the present disclosure may be used standalone, or may be a wearable electronic device having various shapes, which can be used in association with other electronic devices. According to an embodiment, the wearable electronic device may be connected with a different electronic device in a communicable manner by the use of a communication module. In this case, the wearable electronic device may output to the different electronic device output information, or may receive the output information of the different electronic device and output it, or may output the output information simultaneously with the different electronic device. According to an embodiment, the output information may be output visually by using a display device, or may be output acoustically by using a speaker device, or may be output tactually by using vibration or the like. According to an embodiment, the communication module may be a near-distance communication module. According to an embodiment, the near-distance communication module may be at least one of a Wireless Fidelity (Wi-Fi) communication module, a Bluetooth communication module, an infrared communication module, and a Near Field Communication (NFC) communication module.

Although the wearable electronic device is described in various embodiments of the present disclosure, the present disclosure is not limited to the electronic device and thus may also be applied to various typical devices to which a strap according to the present disclosure is applicable.

In the description of various embodiments of the present disclosure, the wearable electronic device may be applied to various devices including a main body, at least one strap coupled to the main body, and a buckle provided to an end portion of the at least one strap.

Although the wearable electronic device is described according to various embodiments of the present disclosure, the present disclosure may also be applied to various typical devices including a strap of the present disclosure and a buckle applied to an end portion of the strap.

In the description of various embodiments of the present disclosure, terms such as a wearable portion, a strap, a band, or the like may be used. It should be noted that such terms are identical constitutional elements having a structure capable of fastening a main body to an external object and capable of accommodating at least one electronic component, and can be replaced with each other.

Figure 1B:
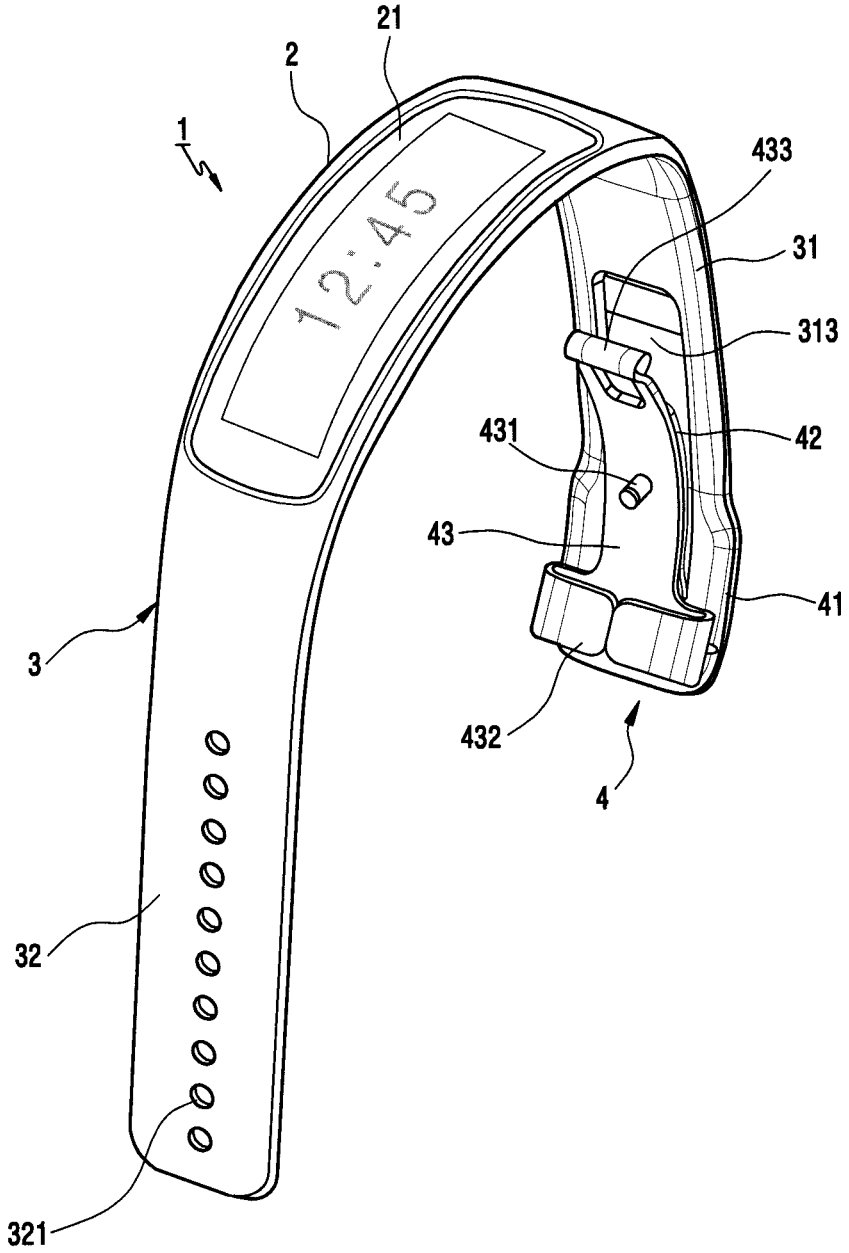
FIG. 1B is a perspective view of a wearable electronic device according to various embodiments of the present disclosure.

FIG. 1B is a perspective view of a wearable electronic device 1 according to various embodiments of the present disclosure. Although the watch-type wearable electronic device 1 that can be worn on a wrist of a human body and a buckle 4 included therein are introduced and explained in the various embodiments of the present disclosure, it is apparent that the present disclosure is not limited thereto.

Referring to FIG. 1B, the wearable electronic device 1 may include a main body 2 and a strap 3 supporting the main body 2. According to an embodiment, the strap 3 is formed as an integral part, and may be divided into a first strap 31 and a second strap 32 in such a manner that the main body 2 is located in the center. According to an embodiment, the strap 3 may consist of two separated straps instead of being formed as an integral part. For example, the wearable electronic device 1 may include the first strap placed to one end of the main body 2 and the second strap placed to the other end of the main body 2.

According to an embodiment, a display 21 may be installed to the main body 2, and the buckle 4 may be installed to at least one strap (e.g., the first strap 31) included in the strap 3. According to an embodiment, the display 21 may use a touch screen device capable of performing a data input and output together. According to an embodiment, various electronic components may be placed to the main body 2. According to an embodiment, the electronic components may include at least one of a camera device, a speaker device, a microphone device, various physical key buttons, and various sensor devices. According to an embodiment, sensors for detecting a human body status and a surrounding situation (e.g., an illumination sensor, a heart rate detection sensor, a temperature sensor, a fingerprint recognition sensor, a motion detection sensor, etc.) may be installed as the sensor device.

According to an embodiment, the buckle 4 may be installed to an end portion of the first strap 31. According to an embodiment, the buckle 4 may include a buckle body 41 fastened to the strap 3, a first link 42 and second link 43 hinge-coupled in the buckle body 41, and a band fixing pole 431 fastened to the second link 43. According to an embodiment, the first link 42 and the second link 43 may be installed in a mutually rotatable manner by a hinge coupling portion 433, and the second link 43 may be installed in a rotatable manner in the buckle body 41. According to an embodiment, the two links 42 and 43 may lead to a more robust and favorable wearable operation when a user uses the wearable electronic device 1, and may provide design aesthetic feeling.

According to an embodiment, the band fixing pole 431 may connect the first strap 31 and the second strap 32 in a manner of penetrating to one of a plurality of insertion holes 321 formed to the second strap 32 guided by a band guide portion 432 installed on an end portion of the second link 43.

According to an embodiment, a first slimming recess 313 having a surface lower than a surface of the first strap 31 may be formed inside the first strap 31. The first slimming recess 313 may be guided in such a manner that at least a portion of the first and second links 42 and 43 are mounted, thereby improving wearing comfort and making a device look slim when wearing the device.

Figure 1C:
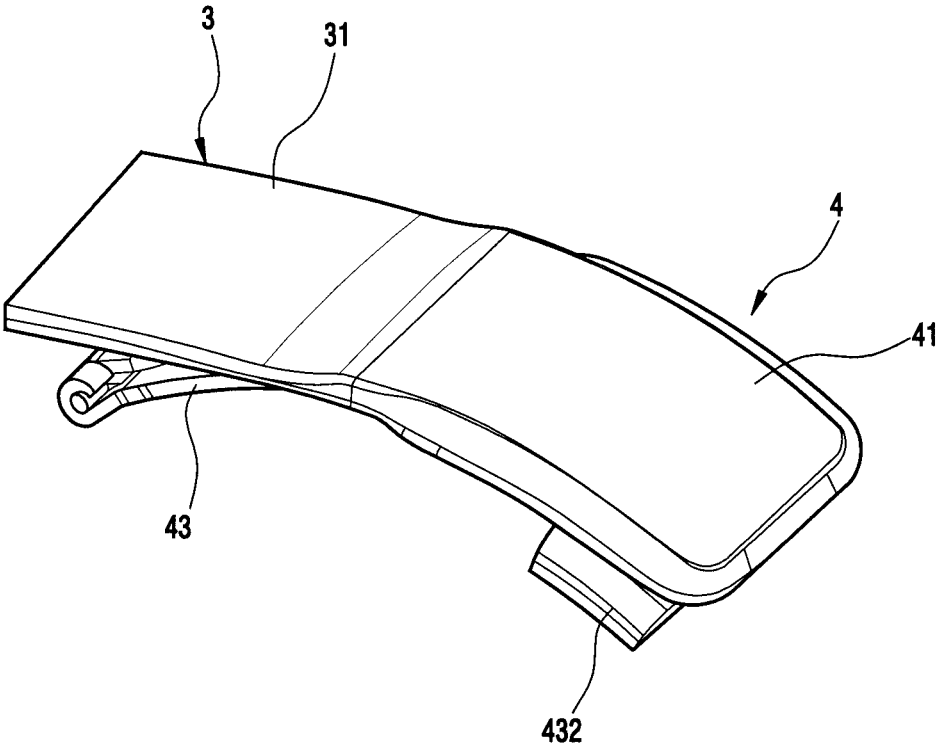
FIG. 1C is a partial perspective view of a buckle of a wearable electronic device, viewed from another direction, according to various embodiments of the present disclosure.
Figure 1D:
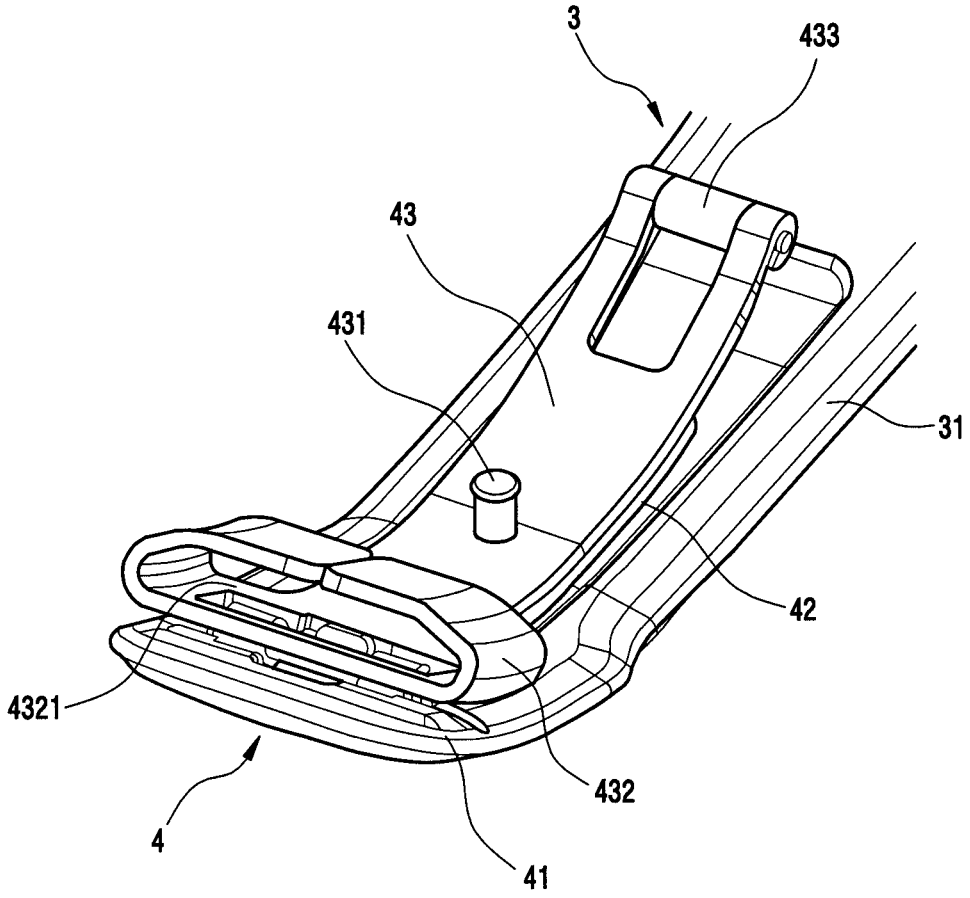
FIG. 1D illustrates a detailed structure of a buckle portion of a wearable electronic device according to various embodiments of the present disclosure.

FIG. 1C is a partial perspective view of a buckle of the wearable electronic device 1, viewed from another direction, according to various embodiments of the present disclosure. FIG. 1D illustrates a detailed structure of a buckle portion of the wearable electronic device 1 according to various embodiments of the present disclosure.

Referring to FIG. 1C and FIG. 1D, the wearable electronic device 1 may have the buckle 4 installed to an end portion of the first strap 31 included in the strap 3. According to an embodiment, the buckle 4 and the first strap 31 may be installed such that outer surfaces thereof are aligned. According to an embodiment, a separation from the buckle 4 caused by a movement of the strap 3 may be avoided in a state in which the first strap 31 with softness and the buckle 4 with hardness are coupled to each other.

According to an embodiment, the first link 42 and the second link 43 may be installed to the buckle body 41 of the buckle 4. One end of the first link 42 may be hinge-coupled to the buckle body 41 in a rotatable manner, and the other end of the first link 42 may be hinge-coupled to one end of the second link 43 in a rotatable manner. According to an embodiment, a band through-hole 4321 for accommodating the second strap 32 may be formed to the other end of the second link 43. According to an embodiment, the band fixing pole 431 may be formed in a protruding manner in the second link 43. Thus the first strap 31 and the second strap 32 may be connected to each other in such a manner that they are inserted to one insertion hole among the plurality of insertion holes 321 formed to the second strap 32 which passes through a band through-hole 4321. According to an embodiment, the first link 42 and the second link 43 may operate in such a manner that they are unfolded in the buckle body 41 with respect to the hinge coupling portion 433.

According to an embodiment, the buckle 4 may use a typical coupling mechanism such as a snap fit, a hook operation structure, or the like for connecting an opposite-side strap in a buckle portion.

Figure 2:
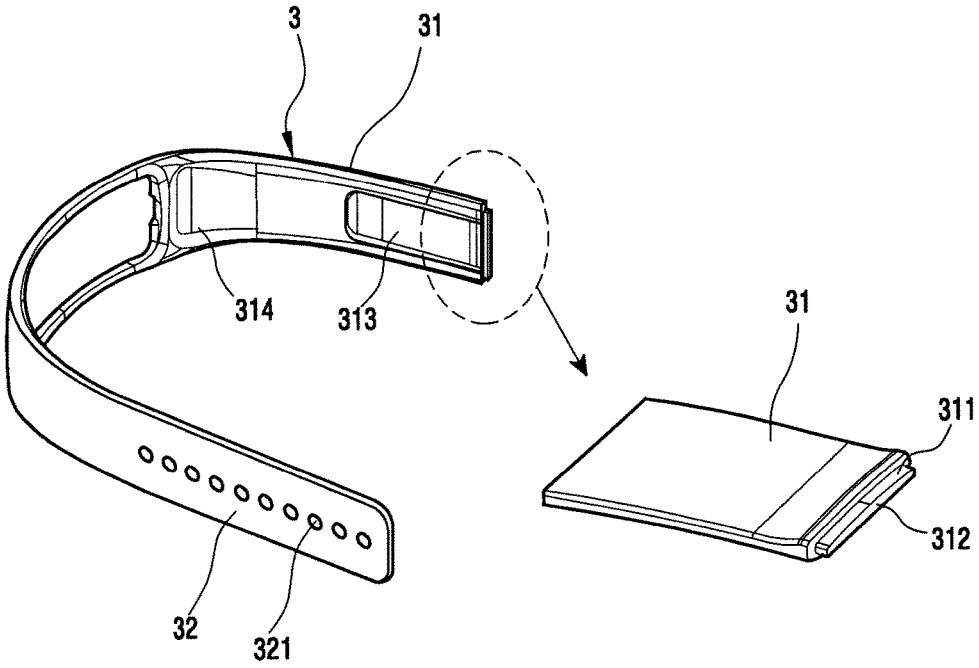
FIG. 2 is a perspective view of a strap according to various embodiments of the present disclosure.

FIG. 2 is a perspective view of the strap 3 according to various embodiments of the present disclosure.

According to various embodiments of the present disclosure, the wearable electronic device 1 may include the buckle 4 installed to one end of the first strap 31 of the strap 3 to connect the first strap 31 and the second strap 32. According to an embodiment, the buckle 4 and the first strap 31 are not directly coupled, and may be coupled by means of an additional connection member (see 5 of FIG. 4A). According to an embodiment, one end of the connection member 5 may be coupled to the first strap 31, and the other end may be coupled to the buckle 4. Hereinafter, the connection member 5 is described in greater detail.

Referring to FIG. 2, the strap 3 includes the first strap 31 and the second strap 32. According to an embodiment, the strap 3 may be formed of a soft material. According to an embodiment, the strap 3 may be formed of a soft material including at least one of silicon, urethane, and rubber. According to an embodiment, a buckle entering portion 311 may be formed in a protruding manner in an end portion of the first strap. The buckle entering portion 311 may be formed to have a smaller cross-section than the first strap 31. Therefore, a height difference may be naturally formed between the first strap 31 and the buckle entering portion 311. When the buckle entering portion 311 of the first strap 31 is fastened in a manner of being inserted to the buckle body 41, they are coupled in such a manner that an outer surface of the buckle body 41 and an outer surface of the first strap are aligned to each other due to the height difference, thereby improving design aesthetic feeling.

According to an embodiment, the first strap 31 may be fastened to the connection member (see 5 of FIG. 4A) by using insert-molding. According to an embodiment, the buckle entering portion 311 may be formed together when the first strap 31 and the connection member (e.g., element 5 of FIG. 4A) are insert-molded. According to an embodiment, insert-molding may be achieved in such a manner that the surface of the connection member 5 and the outer surface of the buckle entering portion 311 are aligned.

According to an embodiment, a first insertion groove 312 may be formed to the buckle entering portion 311 of the first strap 31 to insert a part of the connection member (see 5 of FIG. 4A) to be described below. According to an embodiment, a part of the connection member 5 may be accommodated in the first insertion groove 312, and may be coupled in such a manner that the surface of the connection member inserted to the first insertion groove 312 and the outer surface of the buckle entering portion 311 are aligned.

Figure 3A:
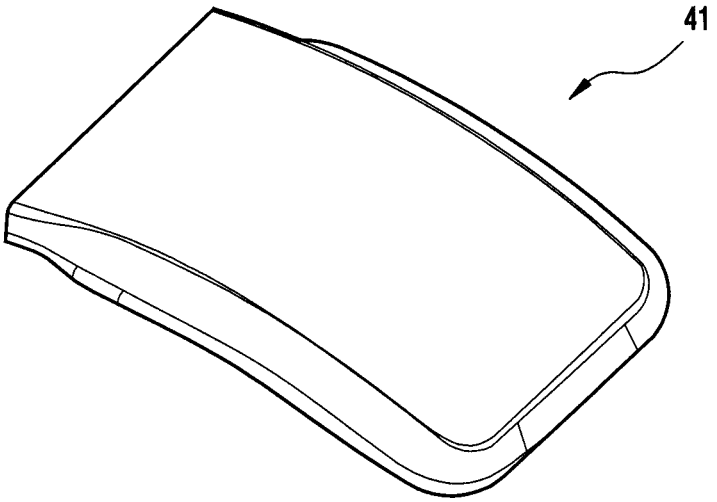
FIG. 3A and FIG. 3B are perspective views of a buckle body according to various embodiments of the present disclosure.
Figure 3B:
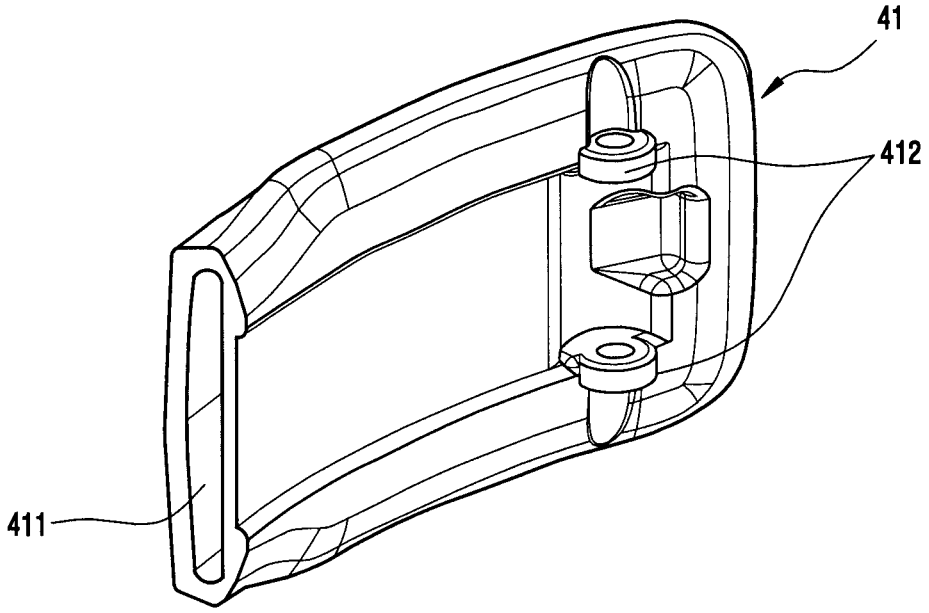

FIG. 3A and FIG. 3B are perspective views of the buckle body 41 according to various embodiments of the present disclosure.

Referring to FIG. 3A and FIG. 3B, the buckle body may be formed of a metal material. According to an embodiment, the buckle body 41 may be formed of a metal material through die-casting or processing operations. However, the present disclosure is not limited thereto, and thus the buckle body 41 may be formed of various materials with hardness. According to an embodiment, a second insertion groove 411 may be formed to the buckle body 41 to insert a part of the connection member 5 to be described below. According to an embodiment, when a part of the connection member 5 protruding from the buckle entering portion 311 of the first strap 31 is fastened by being inserting to the second insertion groove 411 of the buckle body 41, they are coupled in such a manner that an outer surface of the buckle 4 and an outer surface of the first strap 31 are aligned, thereby enhancing design aesthetic feeling.

Figure 4A:
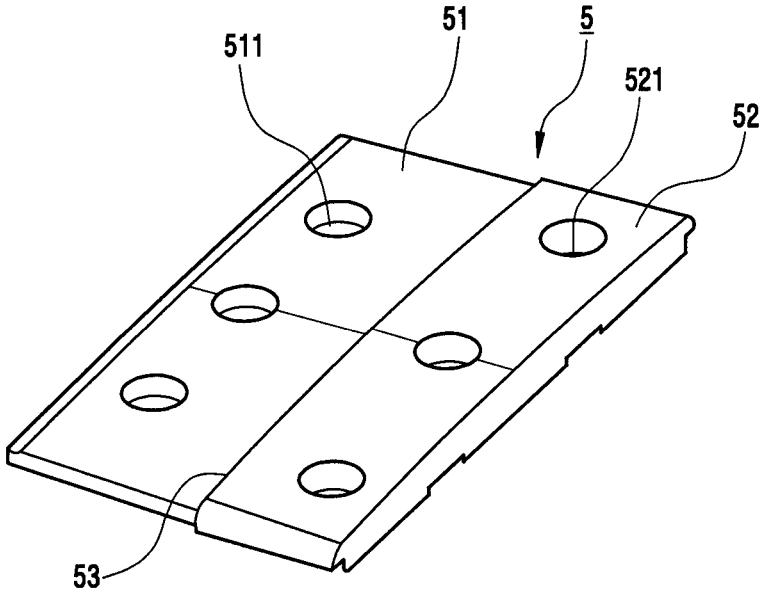
FIG. 4A and FIG. 4B are front and rear perspective views of a connection member according to various embodiments of the present disclosure.
Figure 4B:
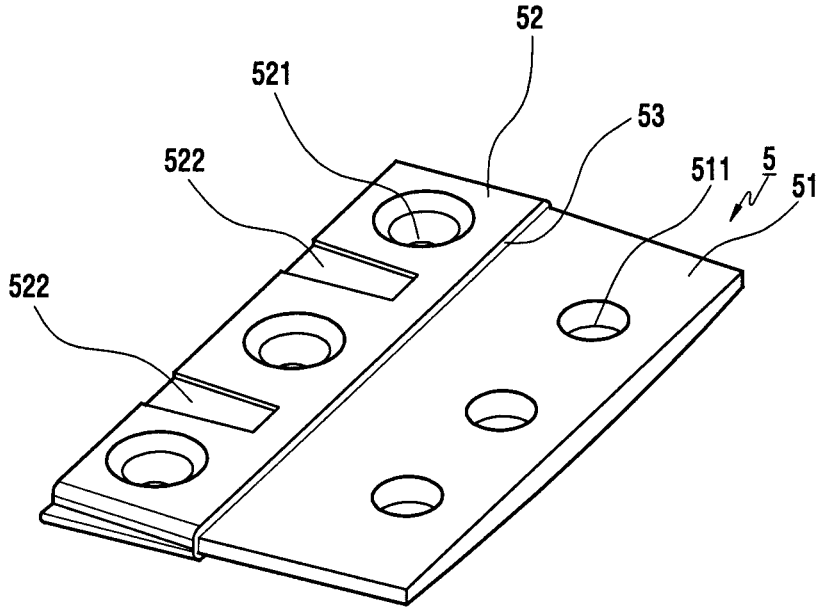

FIG. 4A and FIG. 4B are front and rear perspective views of the connection member 5 according to various embodiments of the present disclosure.

Referring to FIG. 4A and FIG. 4B, the connection member 5 may be formed of a PolyCarbonate (PC) material. However, the connection member 5 is not limited thereto, and may be formed of various materials (e.g., a metal material) having a hardness suitable for connecting the buckle 4 and the strap 3.

According to an embodiment, the connection member 5 may include a band insertion portion 51 for inserting to the first insertion groove 312 formed to the buckle entering portion 311 of the first strap 31 and a buckle insertion portion 52 for inserting to the second insertion groove 411 formed to the buckle body 41 of the buckle 4. According to an embodiment, the band insertion portion 51 and the buckle insertion portion 52 may be formed as an integral part. According to an embodiment, a height difference portion 53 having a height difference may be formed to an edge portion of the band insertion portion 51 and the buckle insertion portion 52. According to an embodiment, a cross-section of the band insertion portion 51 may be formed to be smaller than a cross-section of the buckle insertion portion 52. This is to allow an outer surface of the buckle insertion portion 52 to be aligned with an outer surface of the buckle entering portion 311 of the first strap 31 when the band insertion portion 51 is inserted to the first insertion groove 312 of the first strap 31.

According to an embodiment, the band insertion portion 51 of the connection member 5 may include a plurality of through-holes 511 formed to have a specific interval. According to an embodiment, the through-hole 511 formed to the band insertion portion 51 may be used as an assistant means for enforcing bonding force when the band insertion portion 51 is coupled to the first insertion groove 312 of the first strap 31.

According to an embodiment, the buckle insertion portion 52 of the connection member 5 may also include a plurality of through-holes 521 formed to have a specific interval. According to an embodiment, the through-hole 521 formed to the buckle insertion portion 52 may be used as an assistant means for enforcing bonding force when the buckle insertion portion 52 is coupled to the second insertion groove 411 of the buckle 4.

According to an embodiment, at least one air guide recess 522 may be formed to the buckle insertion portion 52 of the connection member 5 in a direction of placing the buckle. According to an embodiment, the air guide recess 522 may prevent an out-leakage of a bonding agent (see 5211 of FIG. 6D) caused by air compression when the buckle insertion portion 52 of the connection member 5 is fastened to the second insertion groove 411 of the buckle body 41 in a bonding manner. According to an embodiment, the air guide recess 522 may prevent an incorrect assembly by leaking compressed air to outside when the buckle insertion portion 52 of the connection member 5 is inserted to the second insertion groove 411 of the buckle body 41.

Figure 5A:
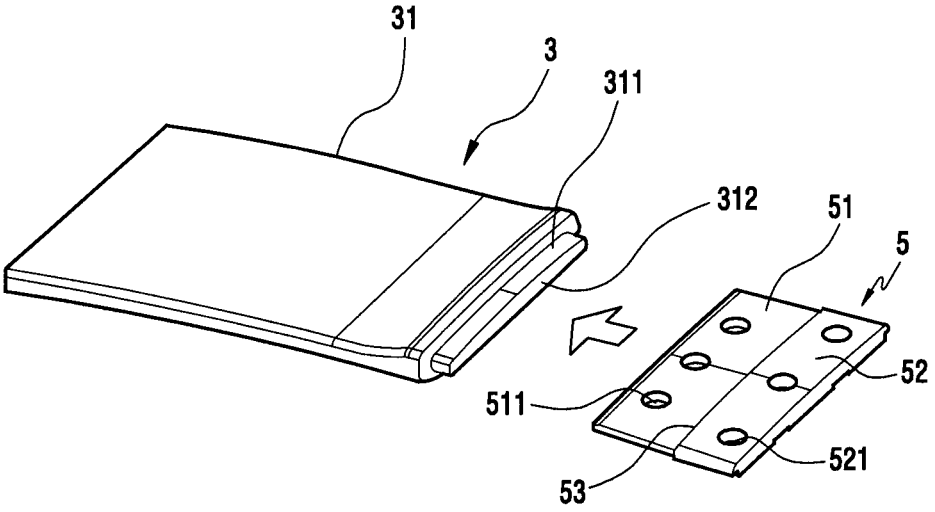
FIG. 5A is an exploded perspective view illustrating a state in which a connection member is coupled to a strap according to various embodiments of the present disclosure.
Figure 5B:
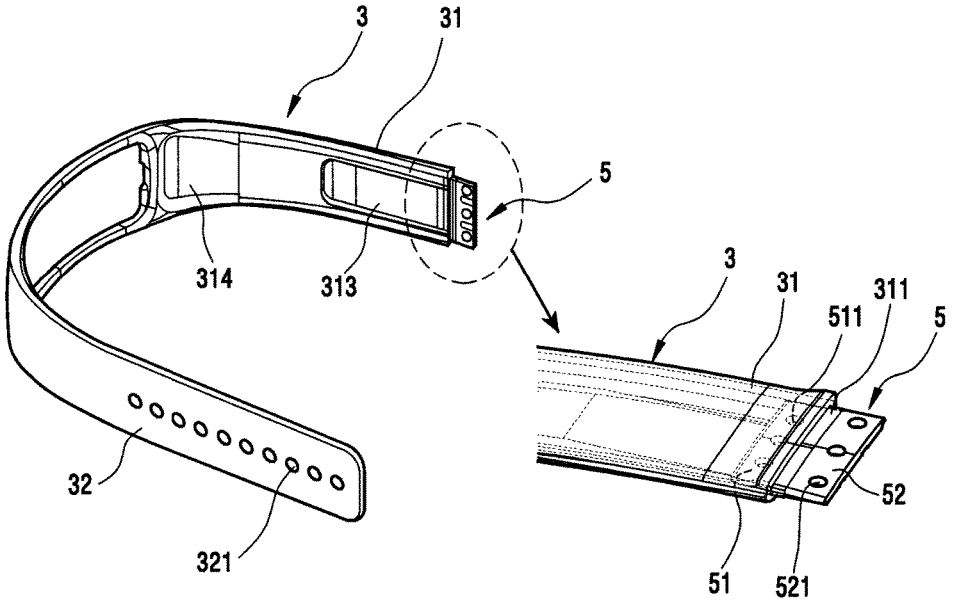
FIG. 5B is a combined perspective view illustrating a state in which a connection member is coupled to a strap according to various embodiments of the present disclosure.

FIG. 5A is an exploded perspective view illustrating a state in which the connection member 5 is coupled to the strap 3 according to various embodiments of the present disclosure. FIG. 5B is a combined perspective view illustrating a state in which the connection member 5 is coupled to the strap 3 according to various embodiments of the present disclosure.

Referring to FIG. 5A and FIG. 5B, the first strap 31 may be fastened to the connection member (see 5 of FIG. 4A) by using insert-molding. According to an embodiment, the buckle-entering portion 311 may be formed together when the first strap 31 and the connection member are insert-molded. According to an embodiment, insert-molding may be achieved in such a manner that the surface of the connection member 5 and the outer surface of the buckle entering portion 311 are aligned. In this case, when performing insert-molding, by filling the first strap 31 to the through-hole 511 of the band insertion portion 51, the connection member 5 may enforce bonding force in the first strap 31.

According to an embodiment, the through-hole 511 of the band insertion portion 51 may be formed as a recess, instead of being formed as a through-hole. In this case, the recess may be formed to both of one side of the band insertion portion 51 of the connection member 5 and an opposite side facing thereto.

According to an embodiment, the connection member 5 may be coupled in a manner of inserting to the first insertion groove 312 formed to the buckle entering portion 311 of the first strap 31. According to an embodiment, the connection member 5 and the first strap 31 may be coupled by using not only the insert-molding but also at least one of tight fitting, bonding, ultrasonic bonding, thermal bonding, thermo-compression, laminating, riveting, screw engagement, and bi-injection molding.

According to an embodiment, when the band insertion portion 51 of the connection member 5 is completely coupled to the first strap 31, the buckle entering portion 311 and the buckle insertion portion 52 of the connection member 5 exposed from the first strap 31 may be coupled in such a manner that outer surfaces thereof are aligned to each other. Therefore, the second insertion groove 411 of the buckle body 41 may accommodate both of the buckle entering portion 311 of the first strap 31 and the buckle insertion portion 52 of the connection member 5, thereby leading to more reliable coupling.

Figure 6A:
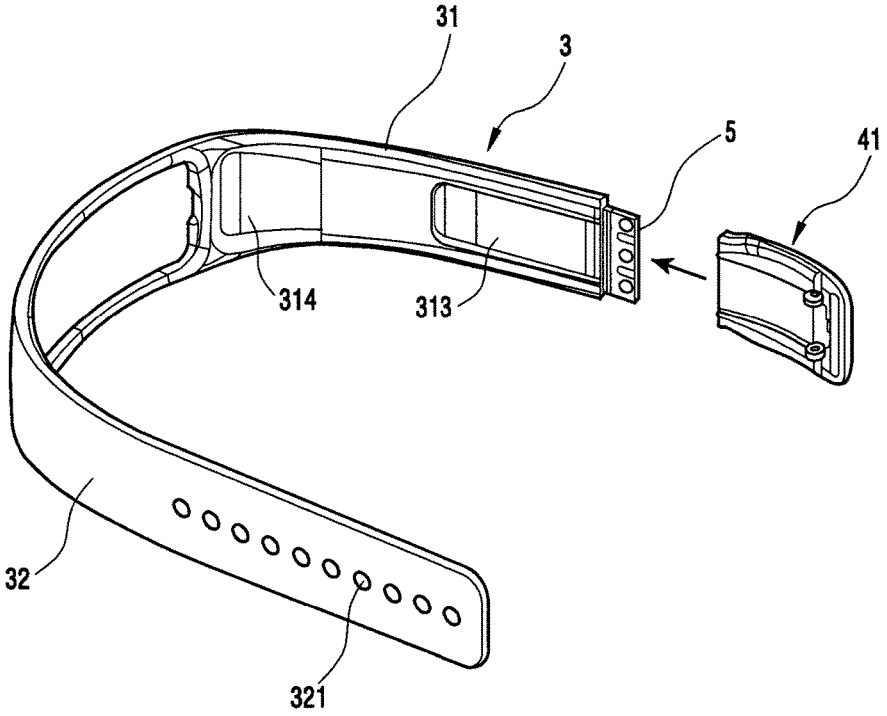
FIG. 6A is an exploded perspective view illustrating a state in which a buckle body is coupled to a strap to which a connection member is installed according to various embodiments of the present disclosure.
Figure 6B:
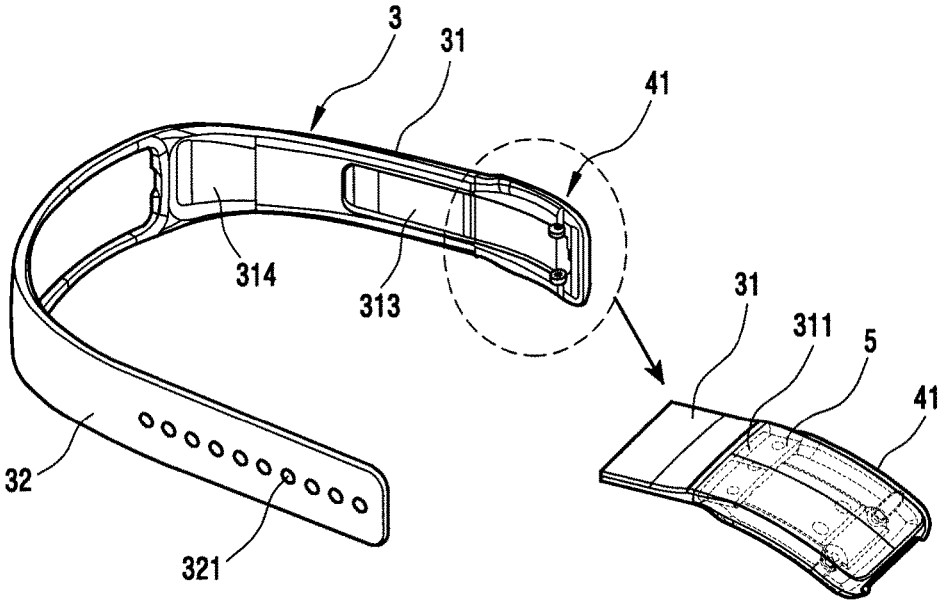
FIG. 6B is an exploded perspective view illustrating a state in which a buckle body is coupled to a strap to which a connection member is installed according to various embodiments of the present disclosure.

FIG. 6A is an exploded perspective view illustrating a state in which the buckle body 41 is coupled to the strap 3 to which the connection member 5 is installed according to various embodiments of the present disclosure. FIG. 6B is an exploded perspective view illustrating a state in which the buckle body 41 is coupled to the strap 3 to which the connection member 5 is installed according to various embodiments of the present disclosure.

Referring to FIG. 6A and FIG. 6B, the buckle insertion portion 52 of the connection member 5 coupled to the first strap 31 in a protruding manner by using insert-molding may be coupled in a manner of inserting to the second insertion portion 411 of the buckle body 41. According to an embodiment, the second insertion portion 411 of the buckle body 41 may accommodate both of the buckle entering portion 311 of the first strap 31 and the buckle insertion portion 52 of the connection member 5.

According to an embodiment, the buckle insertion portion 52 of the connection member 5 may be fastened to the second insertion portion 411 of the buckle body 41 in a manner of bonding, screw engagement, or the like. According to an embodiment, if the buckle body 41 is fastened to the first strap 31 in a bonding manner, the through-hole 521 may accommodate a bonding agent (see 5211 of FIG. 6D), thereby enforcing bonding force between the strap 3 and the buckle 4. According to an embodiment, if the buckle 4 is fastened to the strap in a screw engagement manner, the through-hole 521 may play a role of an engagement hole through which a screw inserted from an outside of the buckle 4 passes or is engaged, thereby also enforcing the bonding force between the strap 3 and the buckle 4. According to an embodiment, the buckle 4 may be fastened to the strap 3 by using both of the bonding and the screw engagement. According to an embodiment, the through-hole 521 formed to the buckle insertion portion 52 may also be replaced with a recess.

Figure 6C:
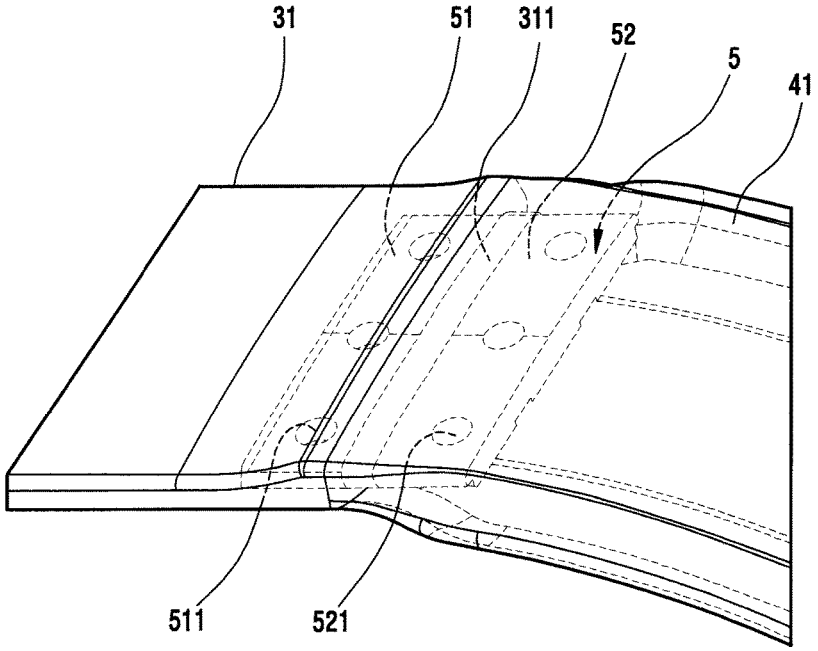
FIG. 6C is a transparent view illustrating important parts in a state in which a buckle body is coupled to a strap to which a connection member is installed according to various embodiments of the present disclosure.
Figure 6D:
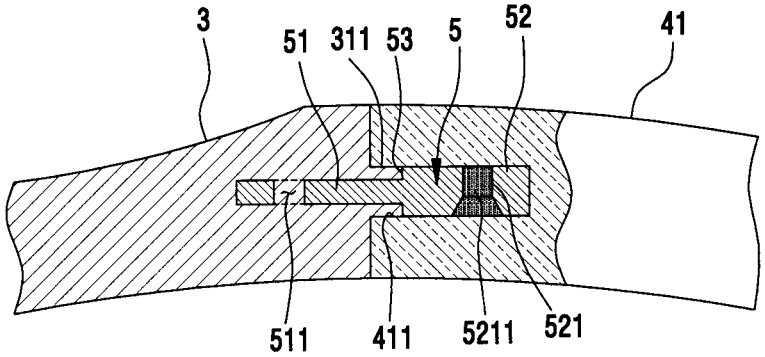
FIG. 6D is a cross-sectional view illustrating a state in which a buckle body is coupled to a strap to which a connection member is installed according to various embodiments of the present disclosure.

FIG. 6C is a transparent view illustrating important parts in a state in which the buckle body 41 is coupled to the strap 3 to which the connection member 5 is installed according to various embodiments of the present disclosure. FIG. 6D is a cross-sectional view illustrating a state in which the buckle body 41 is coupled to the strap 3 to which the connection member 5 is installed according to various embodiments of the present disclosure.

Referring to FIG. 6C and FIG. 6D, if the buckle body 41 is coupled to the first strap 31, the connection member 5 is not exposed to an outside, and the buckle body 41 and the first strap 31 may be coupled in a manner of being in contact with each other. According to an embodiment, if the buckle body 41 is coupled to the first strap 31, the first strap 31 and the buckle body 41 are coupled in such a manner that outer surfaces thereof are aligned.

According to an embodiment, when the buckle body 41 is completely coupled to the first strap 31 by means of the connection member 5, a strap material (e.g., resin, urethane, rubber, silicon, etc.) is filled in the through-hole 511 formed to the band insertion portion 51 of the connection member 5 by using insert-molding, thereby enforcing bonding force.

According to an embodiment, when the buckle body 41 is completely coupled to the first strap 31 by means of the connection member 5, a bonding agent 5211 is filled in the through-hole 521 formed to the buckle insertion portion 52 of the connection member 5, thereby enforcing bonding force. According an embodiment, the second insertion portion 411 of the buckle body 41 accommodates both of the buckle entering portion 311 of the first strap 31 and the buckle insertion portion 52 of the connection member 5, thereby also enforcing bonding force.

Figure 7A:
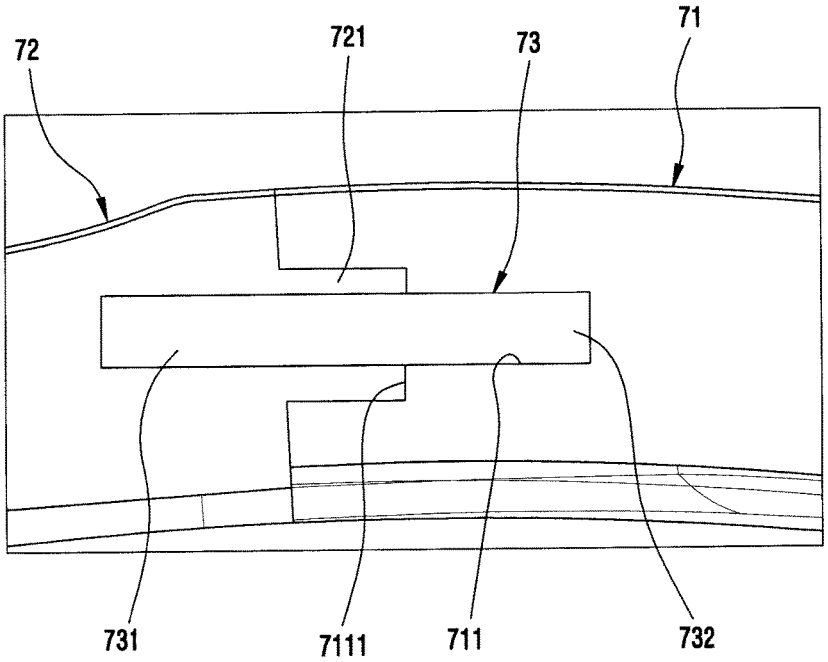
FIG. 7A, FIG. 7B, and FIG. 7C illustrate a state in which a strap and a buckle are coupled by means of a connection member according to various embodiments of the present disclosure.
Figure 7B:
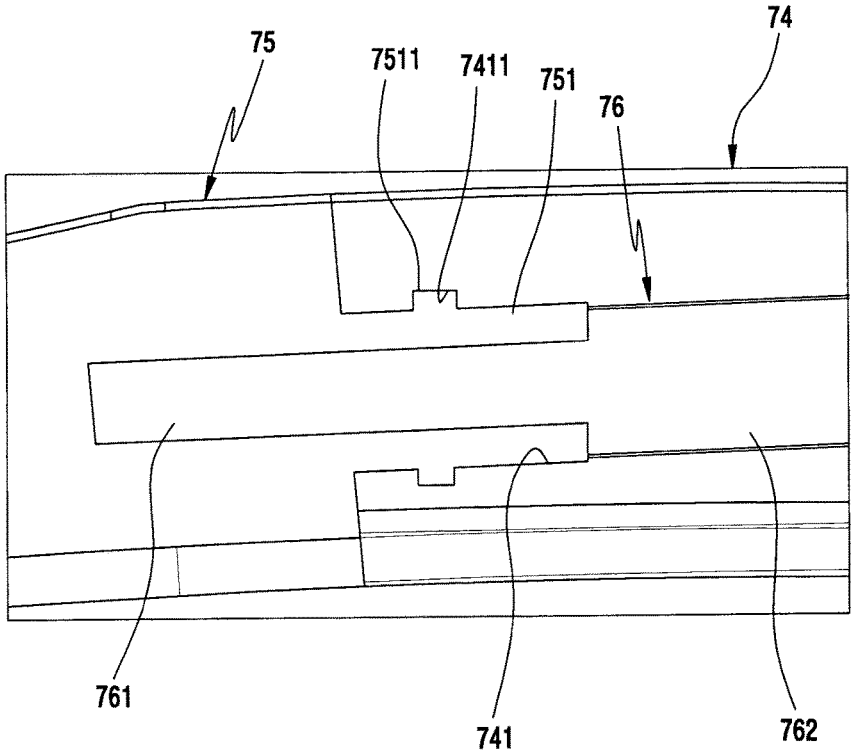
Figure 7C:
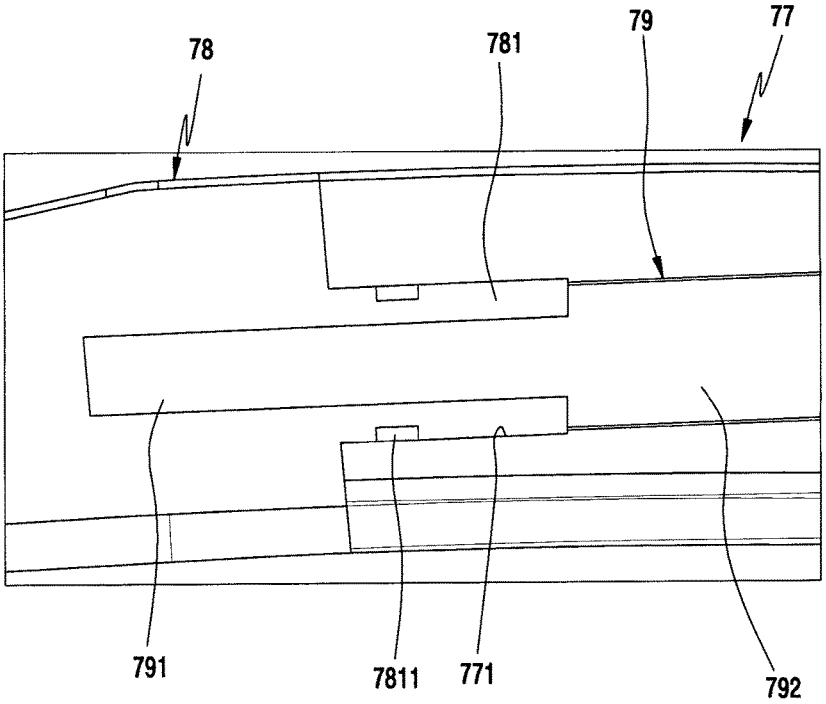

FIG. 7A to FIG. 7C illustrate a state in which a strap and a buckle are coupled by means of a connection member according to various embodiments of the present disclosure.

Referring to FIG. 7A, a strap 72 and a buckle 71 may be coupled by means of a connection member 73. According to an embodiment, the connection member 73 and the strap 72 may be coupled and the connection member 73 and the buckle 71 may be coupled by using at least one of insert-molding, tight fitting, bonding, ultrasonic bonding, thermal bonding, thermo-compression, laminating, riveting, screw engagement, and bi-injection molding.

According to an embodiment, the connection member 73 may be formed not to have a height difference caused by an additional height difference between a band insertion portion 731 coupled to the strap 72 and a buckle insertion portion 732 to be inserted to the buckle 71, and may be formed such that outer surfaces thereof are aligned. In this case, a height difference portion 7111 may be formed to a second insertion portion 711, so that a buckle entering portion 721 of the strap 72 is guided to the second insertion portion 711 of the buckle 71.

Referring to FIG. 7B, a strap 75 and a buckle 74 may be coupled by means of a connection member 76. According to an embodiment, the connection member 76 and the strap 75 may be coupled and the connection member 76 and the buckle 74 may be coupled by using at least one of the aforementioned insert-molding, bonding, screw engagement, tight fitting, and thermal bonding.

According to an embodiment, the connection member 76 may be formed such that a band insertion portion 761 coupled to the strap 75 has a height difference with respect to a buckle insertion portion 762 inserted to the buckle 74. According to an embodiment, the buckle 74 may be coupled to the strap 75 in such a manner that a buckle accommodating groove 741 of the buckle accommodates both of a buckle entering portion 751 of the strap 75 and the buckle insertion portion 762 of the connection member 76. According to an embodiment, at least one hooking protrusion 7511 may be formed to an outer surface of the buckle-entering portion 751. According to an embodiment, the hooking protrusion 7511 may be brought in contact while an inner surface of a second insertion groove is pressed. According to an embodiment, a hooking groove 7411 for accommodating the hooking protrusion 7511 may be formed to an inner surface of the second insertion groove 741. However, the present disclosure is not limited thereto, and thus the hooking protrusion may be formed to an outer surface of the buckle insertion portion 762, or the hooking groove may be formed at a corresponding location of the second insertion groove 741. According to an embodiment, the hooking groove may prevent a bonding agent from leaking outside while assisting bonding force of the buckle 74 and the strap 75.

Referring to FIG. 7C, a strap 78 and a buckle 77 may be coupled by means of a connection member 79. According to an embodiment, the connection member 76 and the strap 75 may be coupled and the connection member 76 and the buckle 74 may be coupled by using at least one of the aforementioned insert-molding, bonding, screw engagement, tight fitting, and thermal bonding.

According to an embodiment, the connection member 79 may be formed such that a band insertion portion 791 coupled to the strap 78 has a height difference with respect to the buckle insertion portion 792 inserted to the buckle 77. According to an embodiment, the buckle 77 may be coupled to the strap 78 in such a manner that a buckle accommodating groove 771 of the buckle accommodates both of a buckle entering portion 781 of the strap 78 and the buckle insertion portion 792 of the connection member 79. According to an embodiment, at least one channel 7811 may be formed to an outer surface of the buckle-entering portion 781. According to an embodiment, when the buckle 77 and the strap 78 are coupled, the channel 7811 may prevent a bonding agent from leaking outside.

Figure 8A:
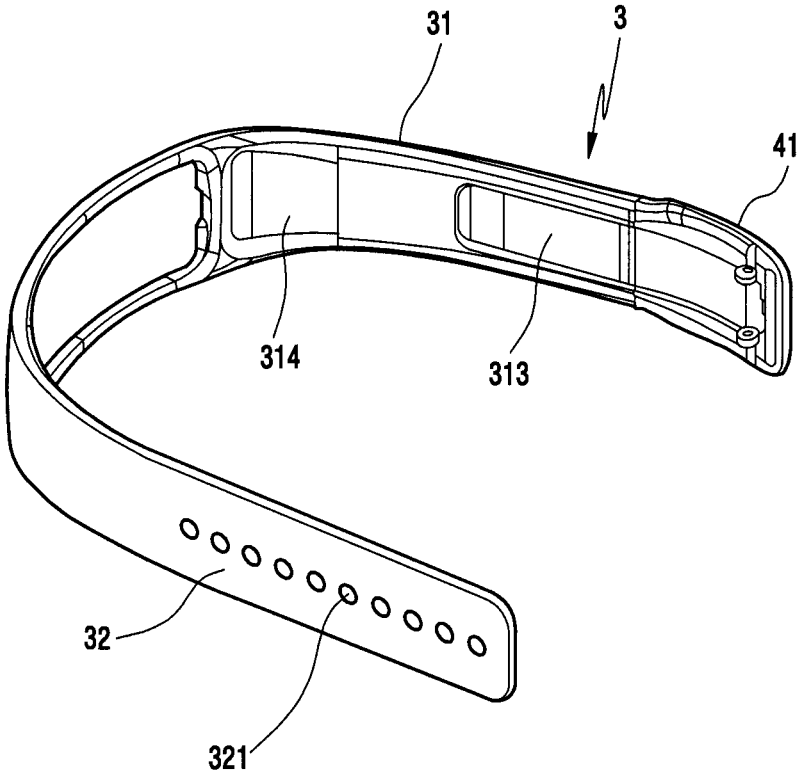
FIG. 8A and FIG. 8B are perspective views illustrating slimming recesses formed to a strap according to various embodiments of the present disclosure.
Figure 8B:
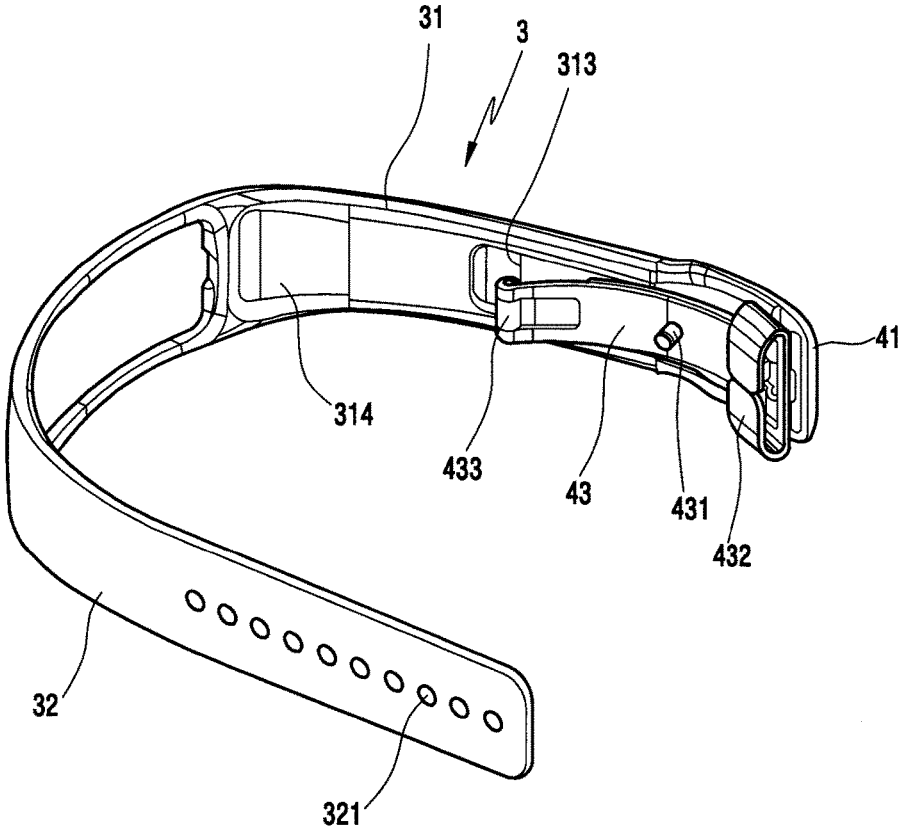

FIG. 8A and FIG. 8B are perspective views illustrating the slimming recesses 313 and 314 formed to the strap 3 according to various embodiments of the present disclosure.

Referring to FIG. 8A and FIG. 8B, at least one of the slimming recesses 313 and 314 may be formed to an inner surface of the first strap 31. According to an embodiment, the strap 3 may include the first slimming recess 313 formed to a portion near the buckle 4 and the second slimming recess 314 formed to a portion near the main body (see 2 of FIG. 1B).

According to an embodiment, the first slimming recess 313 may accommodate at least one part of the first link 42 and the second link 43, thereby improving wearing comfort and contributing to a slimness when the electronic device (see 1 of FIG. 1B) is worn on a wrist.

According to an embodiment, the second slimming recess 314 of the strap 3 is generally increased in width and thickness to achieve solid bonding with the main body, and thus flexibility may be significantly lower than that of an end portion of the strap 3. According to an embodiment, the second slimming recess 314 may partially decrease the thickness of the strap 3, thereby enforcing the flexibility.

Figure 9A:
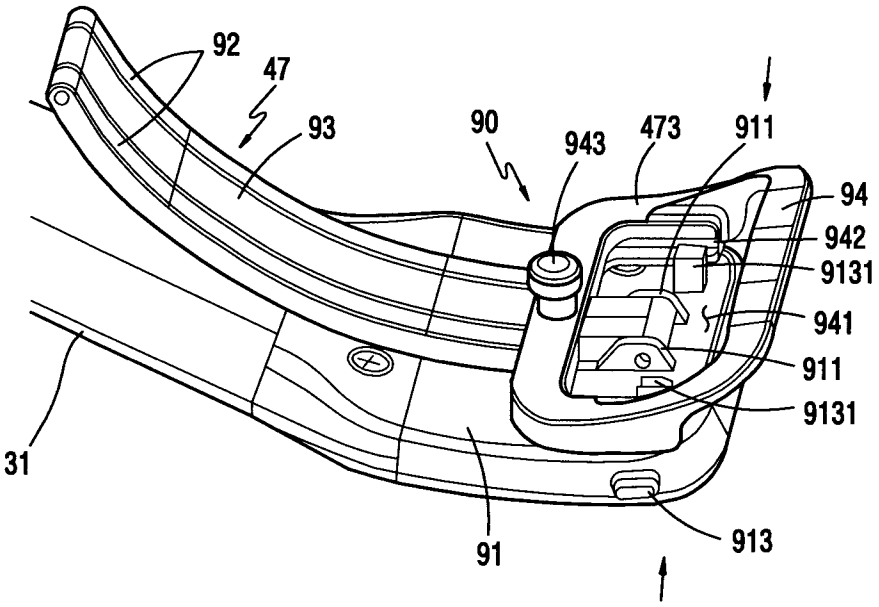
FIG. 9A and FIG. 9B are perspective views illustrating important parts of a buckle installed to a strap according to various embodiments of the present disclosure.

FIG. 9A is a perspective view illustrating important parts of a buckle 90 installed to the strap 31 according to various embodiments of the present disclosure.

Referring to FIG. 9A, the buckle 90 coupled to the strap 31 may be configured such that a first link 93 and a second link 92 are installed to a buckle body 91 in a rotatable manner. According to an embodiment, the first link 93 may be fastened to a pair of hinge arms 911 formed to an outer surface of the buckle body 91 in a rotatable manner, and the second link 92 may be hinge-coupled to an end portion of the first link 93 in a rotatable manner.

According to an embodiment, a band guide portion 94 including a band guide space 941 and a band fixing pole 943 may be formed to an end portion of the second link 92. According to an embodiment, a pushing protrusion 913 may protrude to an outside (e.g., both lateral sides) of the buckle body 91, and a locker 9131 placed to a surface on which the links 92 and 93 of the buckle body 91 are installed may move depending on a push action of the pushing protrusion 913. According to an embodiment, the locker 9131 may be hooked to a hooking piece 942 protruding to the band guide space 941 to stop an arbitrary movement of the links 92 and 93. According to an embodiment, in a state in which the first link 93 and the second link 92 are folded, the hooking piece 942 is stopped by being hooked to the locker 9131, and the locker 9131 moves by a push action of the pushing protrusion 913, thereby being able to release the stopping of the hooking piece 942.

Figure 9B:
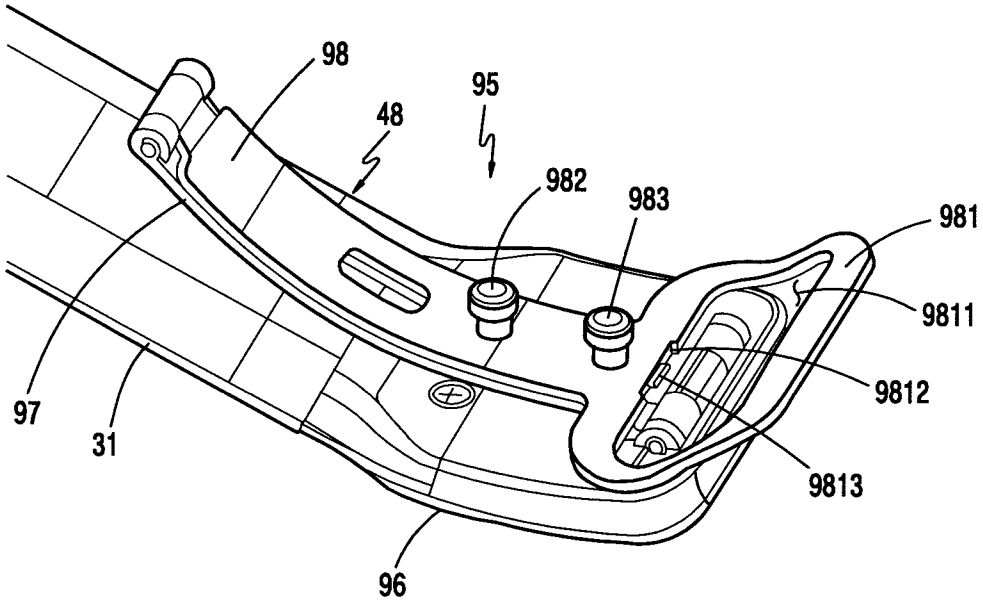

FIG. 9B is a perspective view illustrating important parts of a buckle 95 installed to the strap 31 according to various embodiments of the present disclosure.

Referring to FIG. 9B, the buckle 95 coupled to the strap 31 may include a first link 97 hinge-coupled to a buckle body 96, a second link 98 hinge-coupled to an end portion of the first link 97 in a rotatable manner, and a band guide portion 981 formed to an end portion of the second link 98 and having a hooking portion 9812 which can be hooked to a protruding piece 9813 formed to a hinge-coupled portion of the first link 97 in a protruding manner. According to an embodiment, the band guide portion 981 may include a band guide space 9811, and may be used in such a manner that the strap 31 passes through the band guide space 9811. According to an embodiment, a pair of band fixing poles 982 and 983 may be formed to the second link 98 with a specific interval. By the use of the two band fixing poles 982 and 983, the strap 31 does not move arbitrarily in a state of being attached to a wrist. According to an embodiment, the number of band fixing poles 982 and 983 to be formed may be greater than or equal to two.

Figure 10:
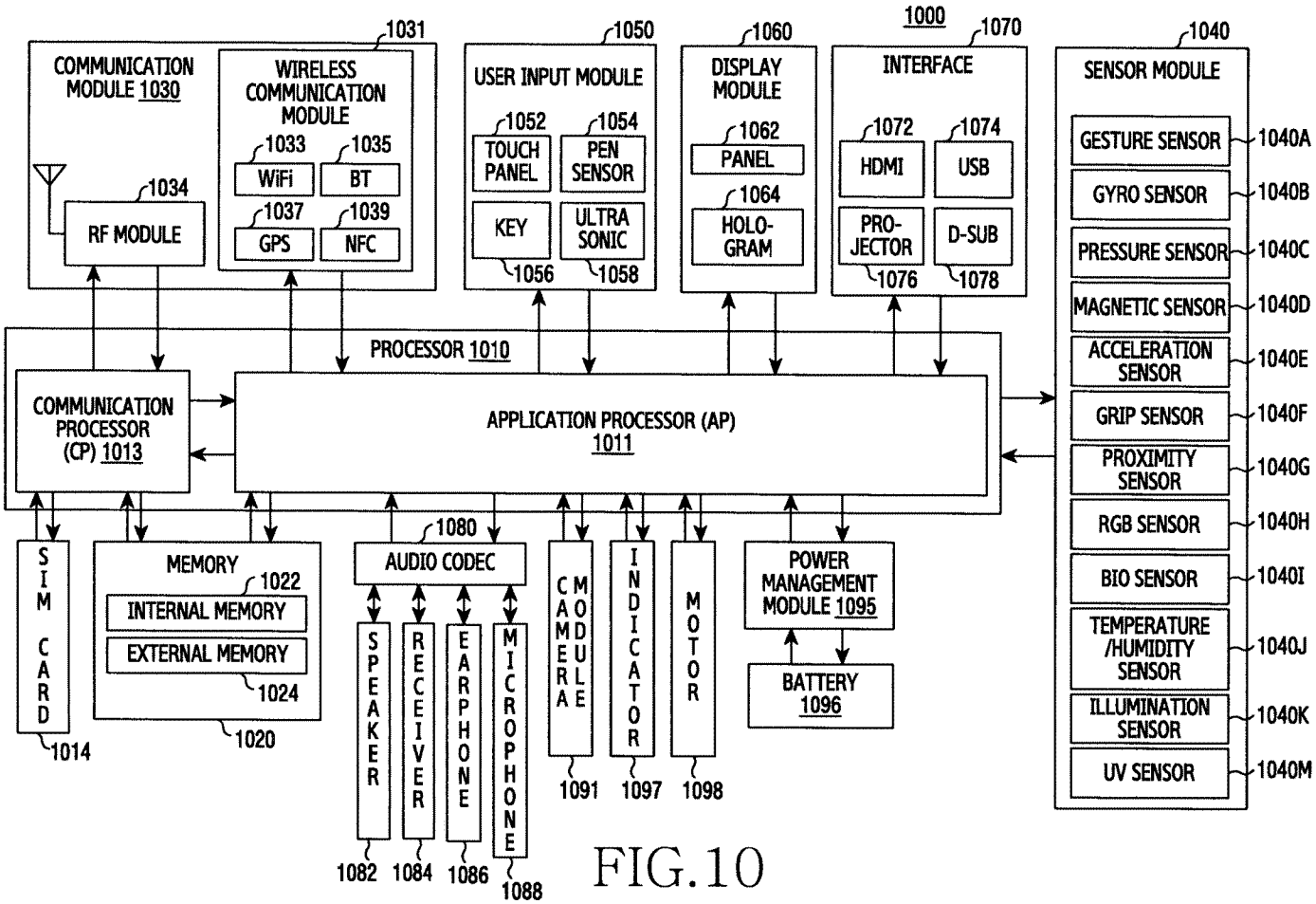
FIG. 10 is a block diagram of a wearable electronic device according to various embodiments of the present disclosure.

FIG. 10 is a block diagram of an electronic device 1000 according to an embodiment of the present disclosure. The electronic device 1000 may be, for example, the electronic device 100 of FIG. 1. Referring to FIG. 10, the electronic device 1000 may include one or more processors 1010, a Subscriber Identity Module (SIM) card 1014, a memory 1020, a communication module 1030, a sensor module 1040, a user input module 1050, a display module 1060, an interface 1070, an audio codec 1080, a camera module 1091, a power management module 1095, a battery 1096, an indicator 1097, and a motor 1098.

The processor 1010 (e.g., the processor 120) may include one or more Application Processor (APs) 1011 and one or more Communication Processors (CPs) 1013. While the AP 1011 and the CP 1013 are included in the processor 1010 of FIG. 10, the AP 1011 and the CP 1013 may be included in different Integrated Circuit (IC) packages. The AP 1011 and the CP 1013 may be included in the single IC package.

The AP 1011 may control hardware or software components connected to the AP 1011 by driving an operating system or an application program, and carry out data processing and operations including multimedia data. The AP 1011 may be implemented using, for example, a System on Chip (SoC). The processor 1010 may further include a Graphic Processing Unit (GPU) (not shown).

The CP 1013 may manage data links and convert the communication protocol in the communications between the electronic device 1000 and the other electronic devices connected over the network. The CP 1013 may be implemented using, for example, a SoC. The CP 1013 may perform at least part of a multimedia control function. The CP 1013 may identify and authenticate the electronic device in the communication network using the SIM card 1014. The CP 1013 may provide the user with services including voice call, video call, text message, and packet data.

The CP 1013 may control the data transmission and reception of the communication module 1030. While the components of the CP 1013, the power management module 1095, and the memory 1020 are separated from the AP 1011 in FIG. 10, the AP 1011 may include part (e.g., the CP 1013) of such components.

The CP 1013 may be the processor 120 of FIG. 1A.

The AP 1011 or the CP 1013 may load and process the instruction or the data received from at least one of its non-volatile memory and the other component, in a volatile memory. The 1011 AP or the CP 1013 may store data received from or generated by at least one of the other components, to the non-volatile memory.

The SIM card 1014 may be inserted to a slot formed at a specific location of the electronic device. The SIM card 1014 may contain unique identification information (e.g., Integrated Circuit Card Identifier (ICCID)) or subscriber information (e.g., International Mobile Subscriber Identity (IMSI)).

The memory 1020 may include an internal memory 1022 and an external memory 1024. The memory 1020 may be, for example, the memory 130 of FIG. 1. The internal memory 1022 may include at least one of, for example, the volatile memory (e.g., Dynamic Random Access Memory (DRAM), Static RAM (SRAM), Synchronous DRAM (SDRAM)) and the non-volatile memory (e.g., One-Time Programmable Read Only Memory (OTPROM), Programmable ROM (PROM), Erasable PROM (EPROM), Electrically EPROM (EEPROM), mask ROM, flash ROM, NAND flash memory, NOR flash memory). The internal memory 1022 may employ a Solid State Drive (SSD). The external memory 1024 may further include, for example, a Compact Flash (CF), a Secure Digital (SD), a Micro-SD, a Mini-SD, an extreme digital (xD), and a memory stick.

The communication module 1030 may include a wireless communication module 1031 and a Radio Frequency (RF) module 1034. For example, the communication module 1030 may be the communication module 160 of FIG. 1. For example, the wireless communication module 1031 may include a Wi-Fi 1033, a BT 1035, a GPS 1037, and an NFC 1039. For example, the wireless communication module 1031 may provide a wireless communication function using a radio frequency. Additionally/substantially, the wireless communication module 1031 may include a network interface (e.g., LAN card) or a modem for connecting the electronic device 1000 to the network (e.g., Internet, LAN, WAN, telecommunication network, cellular network, satellite network, or POTS).

The RF module 1034 may control the data transmission and reception, for example, the transmission and reception of the RF signal or the paged electric signal. For example, the RF module 1034 may include a transceiver, a Pulse Amplitude Module (PAM), a frequency filter, or a Low Noise Amplifier (LNA) which are not shown. The RF module 1034 may further include a component, for example, conductor or conducting wire, for sending and receiving electromagnetic waves in free space during the wireless communication.

The sensor module 1040 may include at least one of, for example, a gesture sensor 1040A, a gyro sensor 1040B, an atmospheric pressure sensor 1040C, a magnetic sensor 1040D, an acceleration sensor 1040E, a grip sensor 1040F, a proximity sensor 1040G, a Red Green Blue (RGB) sensor 1040H, a biometric sensor 1040I, a temperature/humidity sensor 1040J, a light sensor 1040K, and an UltraViolet (UV) sensor 1040M. The sensor module 1040 may measure a physical quantity or detect the operation status of the electronic device, and convert the measured or detected information to an electric signal. Additionally/substantially, the sensor module 1040 may include, for example, an E-noise sensor (not shown), an electromyography (EMG) sensor (not shown), an electroencephalogram (EEG) sensor (not shown), an electrocardiogram (ECG) sensor (not shown), or a finger print sensor. The sensor module 1040 may further include a control circuit for controlling its one or more sensors.

The user input module 1050 may include a touch panel 1052, a (digital) pen sensor 1054, a key 1056, and an ultrasonic input device 1058. For example, the touch panel 1052 may recognize the touch input using at least one of capacitive, resistive, infrared, and Surface Acoustic Wave (SAW) techniques. The touch panel 1052 may further include a controller (not shown). The capacitive touch panel may recognize not only the direct touch but also the proximity. The touch panel 1052 may further include a tactile layer. In this embodiment, the touch panel 1052 may provide a tactile response to the user.

The (digital) pen sensor 1054 may be implemented using, for example, the same or similar method as or to the user's touch input, or using a separate recognition sheet. For example, the key 1056 may include a keypad or a touch key. The ultrasonic input device 1058, which obtains data by detecting microwave through a microphone 1088 in the electronic device, allows radio frequency identification through the pen which generates an ultrasonic signal. The electronic device 1000 may receive the user input from an external device (e.g., a network, a computer, a server) connected using the communication module 1030.

The display module 1060 may include a panel 1062 or a hologram 1064. The panel 1062 may employ, for example, a Liquid Crystal Display (LCD) or an Active Matrix Organic Light Emitting Diode (AMOLED). The panel 1062 may be implemented, for example, flexibly, transparently, or wearably. The panel 1062 may be constructed as the single module with the touch panel 1052. The hologram 1064 may present a three-dimensional image in the air using interference of light. The display module 1060 may further include a control circuit for controlling the panel 1062 or the hologram 1064.

The interface 1070 may include, for example, a High Definition Multimedia Interface (HDMI) 1072, a Universal Serial Bus (USB) 1074, a projector 1076, and a D-subminiature (D-sub) 1078. Additionally/substantially, the interface 1070 may include, for example, a SD/Multi-Media Card (MMC) or Infrared Data Association (IrDA), which are not shown.

The audio codec 1080 may convert the voice to an electric signal and vice versa. For example, the audio codec 1080 may convert voice information which is input or output through, for example, a speaker 1082, a receiver 1084, an earphone 1086, or the microphone 1088.

The camera module 1091 may capture a still picture and a moving picture, and may include one or more image sensors (e.g., front lens or rear lens), an Image Signal Processor (ISP) (not shown), or a flash LED (not shown).

The power management module 1095 may manage power of the electronic device 1000. For example, the power management module 1095 may include a Power Management IC (PMIC), a charger IC, or a battery fuel gauge (not shown).

The PMIC may be mounted in, for example, an IC or a SoC conductor. The charging type may be divided to a wired type and a wireless type. The charger IC may charge the battery and prevent overvoltage or overcurrent from flowing from the charger. The charger IC may include a charger IC for at least one of the wired charging type or the wireless charging type. The wireless charging type includes, for example, magnetic resonance, magnetic induction, and microwave, and may further include an additional circuit, for example, coil loop, resonance circuit, rectifier circuit, for the wireless charging.

The battery fuel gauge may measure, for example, the remaining capacity of the battery 1096 and the voltage, the current, or the temperature of the charging. The battery 1096 may supply the power by generating the electricity. For example, the battery 1096 may be a rechargeable battery.

The indicator 1097 may display a specific status, for example, booting state, message state, or charging state of the hardware 1000 or part (e.g., AP 1011) of the hardware 1000. The motor 1098 may convert the electric signal to a mechanic vibration.

Although it is not depicted here, the electronic device 1000 may further include a processor (e.g., GPU) for supporting mobile TV. For example, the processor for supporting the mobile TV may process media data in conformity with Digital Multimedia Broadcasting (DMB), Digital Video Broadcasting (DVB), or media flow standard. The aforementioned hardware components may include one or more components, and the names of the corresponding components of the present disclosure may differ according to the type of the electronic device. The hardware of the present disclosure may include at least one of the components, omit some components, or further include other components. Some of the hardware components may be united to the single entity to carry out the same functions of the corresponding components.

Each of the aforementioned constitutional elements of the electronic device according to the present disclosure may consist of one or more components, and names thereof may vary depending on a type of electronic device. The electronic device according to the present disclosure may include at least one of the aforementioned constitutional elements. Some of the constitutional elements may be omitted, or additional other constitutional elements may be further included. In addition, some of the constitutional elements of the electronic device according to the present disclosure may be combined and constructed as one entity, so as to equally perform functions of corresponding constitutional elements before combination.

A term "module" used in the present disclosure may imply a unit including, for example, one of hardware, software, and firmware or a combination of two or more of them. The "module" may be interchangeably used with a term such as a unit, logic, a logical block, a component, a circuit, and the like. The "module" may be a minimum unit of an integrally constituted component or may be a part thereof. The "module" may be a minimum unit for performing one or more functions or may be a part thereof. The "module" may be mechanically or electrically implemented. For example, the "module" of the present disclosure may include at least one of an Application-Specific Integrated Circuit (ASIC) chip, a Field-Programmable Gate Arrays (FPGAs), and a programmable-logic device, which are known or will be developed and which perform certain operations.

According to various embodiments, at least some parts of a device (e.g., modules or functions thereof) or method (e.g., operations) of the present disclosure may be implemented with an instruction stored in a computer-readable storage media for example. If the instruction is executed by one or more processors (e.g., the processor 120), the one or more processors may perform a function corresponding to the instruction. The computer-readable storage media may be, for example, the memory 130. At least some parts of the programming module may be implemented (e.g., executed), for example, by the processor 120. At least some parts of the programming module may include modules, programs, routines, sets of instructions, processes, and the like, for performing one or more functions.

The computer readable recording medium may be a hardware device configured particularly to store and perform a program instruction (e.g., program module), for example, a hard disk, a magnetic medium such as a floppy disc and a magnetic tape, an optical storage medium such as a Compact Disc-ROM (CD-ROM) or a Digital Versatile Disc (DVD), a magnetic-optic medium such as a floptical disc, a Read Only Memory (ROM), a Random Access Memory (RAM), a flash memory, and the like. An example of the program instruction includes not only a machine language created by a compiler but also a high-level language executable by a computer by using an interpreter or the like. The aforementioned hardware device may be configured to operate as one or more software modules to perform the operation of the present disclosure, and the other way around is also possible.

The module or programming module according to the present disclosure may further include at least one or more constitutional elements among the aforementioned constitutional elements, or may omit some of them, or may further include additional other constitutional elements. Operations performed by a module, programming module, or other constitutional elements of the present disclosure may be executed in a sequential, parallel, repetitive, or heuristic manner. In addition, some of the operations may be executed in a different order or may be omitted, or other operations may be added.

According to various embodiments, in a storage medium having instructions stored therein, when the instructions are executed by at least one processor, the processor is configured to perform at least one operation. The at least one operation may include an operation of detecting a screen transformation of the electronic device, and if the change satisfies a pre-defined condition, may include at least one of operations of changing a size of an output screen, changing an output position, and changing an output order.

An electronic device according to various embodiments of the present disclosure may control an output screen without having to generate an input for a window control, by detecting a screen transformation for a screen control of the electronic device, for example, by detecting that a display is transformed and thereafter is restored to an original shape.

While the present disclosure has been shown and described with reference to certain embodiments thereof, it will be understood by those skilled in the art that various changes in form and details may be made therein without departing from the spirit and scope of the disclosure as defined by the appended claims. Therefore, the scope of the present disclosure is defined not by the detailed description of the present disclosure but by the appended claims, and all differences within the scope will be construed as being included in the present disclosure.

According to various embodiments of the present disclosure, a wearable electronic device can enhance hardness and design aesthetic feeling while improving an assembling capability and reducing a manufacturing cost. In addition, a buckle is assembled to a strap by means of an additional connection member, thereby contributing to a slimness of the device.

According to the aforementioned embodiments, a watch-type electronic device is illustrated as a wearable device, and at least one strap fastened to a main body of the electronic device is illustrated and described as a strap of the electronic device. However, the present disclosure is not limited thereto, and thus the present disclosure may also be applied to various types of straps included in various types of wearable devices.

What is claimed is:

1. A wearable electronic device comprising:

a main body;

at least one strap connected to at least one part of the main body, wherein the at least one strap includes a first insertion groove formed at an end portion of the strap;

a buckle installed to the strap; and a connection member connecting the buckle and the strap, wherein the connection member includes:

a band insertion portion coupled to the first insertion groove, wherein the portion of the connection member securable to the strap within the first insertion groove includes the band insertion portion; and a buckle insertion portion extended from the band insertion portion and coupled to a second insertion groove formed in the buckle, wherein the first insertion groove is formed in a buckle entering portion formed in an end portion of the strap in a protruding manner to have a smaller area than the strap, and wherein the second insertion groove of the buckle accommodates both of the buckle entering portion of the strap and the buckle insertion portion of the connection member, and thus is installed such that the connection member is not exposed to an outside.

2. The wearable electronic device of claim 1, wherein the connection member is coupled in such a manner that an outer surface of the buckle entering portion and an outer surface of the buckle insertion portion are aligned.

3. The wearable electronic device of claim 1, wherein at least one hooking protrusion is formed to an outer surface of at least one of the buckle entering portion of the strap and the buckle insertion portion of the connection member, and a hooking recess for accommodating the hooking protrusion is formed at a corresponding location of the second insertion groove, so that a bonding agent is prevented from leaking when bonding is performed, while assisting bonding force of the strap and the buckle.

4. The wearable electronic device of claim 1, wherein at least one recess-shaped channel is formed to an outer surface of at least one of the buckle entering portion of the strap and the buckle insertion portion of the connection member, so that a bonding agent is prevented from leaking, while assisting bonding force of the strap and the buckle.

5. The wearable electronic device of claim 1, wherein at least one through-hole is formed in the band insertion portion of the connection member, and when the band insertion portion of the connection member is coupled to the first insertion groove of the strap, coupling force is assisted by accommodating a bonding agent, by inserting a part of the strap, or by engaging a screw.

6. The wearable electronic device of claim 1, wherein at least one through-hole is formed in the buckle insertion portion of the connection member, and when the buckle insertion portion of the connection member is coupled to the second insertion groove of the strap, coupling force is assisted by accommodating a bonding agent, by inserting a part of the strap, or by engaging a screw.

7. The wearable electronic device of claim 1, wherein at least one air guide recess is formed in the buckle insertion portion of the connection member in a direction of placing the buckle so as to leak compressed air and enforce coupling force when coupled.

8. The wearable electronic device of claim 1, wherein the connection member is applied not to be exposed to an outside in such a manner that at least one part is inserted to the strap and the remaining parts are inserted to the buckle.

9. The wearable electronic device of claim 8, wherein the strap and the buckle are coupled in such a manner that outer surfaces thereof are aligned and do not have a gap therebetween.

10. The wearable electronic device of claim 1, wherein the connection member is coupled to the strap and the buckle by using at least one of insert-molding, tight fitting, bonding, ultrasonic bonding, thermal bonding, thermo-compression, laminating, riveting, screw engagement, and bi-injection molding.

11. The wearable electronic device of claim 1, wherein the strap is formed of a soft material selected from at least one of rubber, silicon, and urethane.

12. The wearable electronic device of claim 1, wherein the buckle is formed of a hard material selected from at least one of PolyCarbonate (PC) and a metal material manufactured by die casting or processing operations.

13. The wearable electronic device of claim 1, wherein a display, a camera, a speaker, a microphone, at least one of a physical key button, at least one sensor, and at least one interface are placed to the main body.

14. A wearable electronic device comprising:

a main body having a display;

at least one strap connected to at least one part of the main body, wherein the strap includes a first insertion groove formed at an end portion of the strap;

a buckle installed to the strap;

at least one band fixing pole formed in the buckle in a protruding manner and inserted to an insertion hole formed in the strap; and a connection member for connecting the buckle and the strap, wherein the connection member comprises:

a band insertion portion coupled to the first insertion groove formed at an end portion of the strap, wherein the portion of the connection member securable to the strap within the first insertion groove includes the band insertion portion; and a buckle insertion portion extended from the band insertion portion and coupled to a second insertion groove formed in the buckle, wherein the first insertion groove is formed to a buckle entering portion formed to an end portion of the strap in a protruding manner to have a smaller area than the strap, and wherein the second insertion groove of the buckle accommodates both of the buckle entering portion of the strap and the buckle insertion portion of the connection member, and thus is installed such that the connection member is not exposed to an outside.

* * * * *